US009251976B2

(12) United States Patent
Takeda

(10) Patent No.: US 9,251,976 B2
(45) Date of Patent: Feb. 2, 2016

(54) FORCE-SENSE IMPARTING TYPE MULTIDIRECTIONAL INPUT DEVICE

(71) Applicant: ALPS ELECTRIC CO., LTD., Tokyo (JP)

(72) Inventor: Hironori Takeda, Tokyo (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 105 days.

(21) Appl. No.: 14/153,652

(22) Filed: Jan. 13, 2014

(65) Prior Publication Data

US 2015/0041291 A1 Feb. 12, 2015

(30) Foreign Application Priority Data

Feb. 7, 2013 (JP) ..... 2013-021857

(51) Int. Cl.

| | |
|---|---|
| ***H01H 9/00*** | (2006.01) |
| ***H01H 15/16*** | (2006.01) |
| ***H01H 15/04*** | (2006.01) |
| ***H01H 15/10*** | (2006.01) |
| ***H01H 25/04*** | (2006.01) |

(52) U.S. Cl.

CPC ..... *H01H 15/16* (2013.01); *H01H 15/04* (2013.01); *H01H 15/10* (2013.01); *H01H 25/04* (2013.01); *H01H 2217/00* (2013.01); *H01H 2221/012* (2013.01); *H01H 2221/024* (2013.01); *H01H 2231/026* (2013.01)

(58) Field of Classification Search

CPC ..... H01H 15/16; H01H 25/04; H01H 15/04; H01H 15/10; H01H 2221/024; H01H 2221/012; H01H 2217/00; H01H 2231/026

USPC ..... 200/16 R

See application file for complete search history.

(56) References Cited

U.S. PATENT DOCUMENTS

| | | | | |
|---|---|---|---|---|
| 8,586,885 | B2 * | 11/2013 | Ishikawa et al. | 200/5 R |
| 2012/0080294 | A1 | 4/2012 | Ishikawa et al. | |
| 2014/0230716 | A1 * | 8/2014 | Ishikawa et al. | 116/205 |

FOREIGN PATENT DOCUMENTS

| | | |
|---|---|---|
| JP | 2012-79620 | 4/2012 |

* cited by examiner

*Primary Examiner* — Renee Luebke
*Assistant Examiner* — Lheiren Mae A Caroc
(74) *Attorney, Agent, or Firm* — Brinks Gilson & Lione

(57) ABSTRACT

A force-sense imparting type multidirectional input device includes a base body including a receiving space, a slider movably disposed in the receiving space, an operating member integrated with the slider, a first driving member that includes a first engaging portion rotationally driven along the movement of the slider, a second driving member that includes a second engaging portion rotationally driven along the movement of the slider and a force-sense imparting unit that imparts a sense of force to an operator through the operating member. The slider is slidingly moved along the first virtual axis and swings about the first virtual axis in a direction orthogonal to the first virtual axis, the first engaging portion of the first driving member is rotationally driven with the sliding movement of the slider, and the second engaging portion of the second driving member is rotationally driven with the swing of the slider.

5 Claims, 23 Drawing Sheets

FORCE-SENSE IMPARTING TYPE MULTIDIRECTIONAL INPUT DEVICE

CLAIM OF PRIORITY

This application claims benefit of priority to Japanese Patent Application No. 2013-021857 filed on Feb. 7, 2013, which is hereby incorporated by reference in its entirety.

BACKGROUND

1. Field of the Disclosure

The present disclosure relates to a force-sense imparting type multidirectional input device and more particularly, to a force-sense imparting type multidirectional input device that is easy to operate.

2. Description of the Related Art

While driving an automobile, a driver may adjust a function by manually operating an operating knob of an on-vehicle control device of a car air conditioner, a car audio system, a car navigation system, or the like. In recent years, a force-sense imparting type multidirectional input device has been used as an input device that is used to perform this operation. Such a force-sense imparting type multidirectional input device reliably performs a desired operation with a good operation feeling by applying an external force (sense of force), such as a resistance force or a thrust, according to the operation amount or the operating direction of an operating knob. A force-sense imparting type multidirectional input device disclosed in Japanese Unexamined Patent Application Publication No. 2012-79620 is a known force-sense imparting type multidirectional input device.

The force-sense imparting type multidirectional input device disclosed in Japanese Unexamined Patent Application Publication No. 2012-79620 will be described below with reference to FIG. 20. FIG. 20 is a cross-sectional view showing the structure of a force-sense imparting type multidirectional input device disclosed in Japanese Unexamined Patent Application Publication No. 2012-79620.

As shown in FIG. 20, a force-sense imparting type multidirectional input device 900 disclosed in Japanese Unexamined Patent Application Publication No. 2012-79620 includes a slider 910 that is disposed so as to be movable on a plane including an X1-X2 direction and a direction (referred to as a Y1-Y2 direction) orthogonal to the X1-X2 direction when seen from a side corresponding to a Z1 direction. For example, it is possible to move a cursor displayed on a display device such as an LCD monitor, which is separately provided, by operating an operating knob 920 connected to the slider 910 to move the slider 910.

When the force-sense imparting type multidirectional input device 900 in the related art is disposed on a center console of the automobile, it is thought that an operator grips an operating knob 920 and performs an input operation while placing one's elbow on an armrest. At this time, when an operator operates the slider 910 for the movement of the slider 910 of the force-sense imparting type multidirectional input device 900 on a plane, there is an operating direction (for example, referred to as an X1-X2 direction) in which the operator feels it easy to rotate the wrist in terms of the structure of a human body. However, since the slider 910 of the force-sense imparting type multidirectional input device 900 is moved along the plane, it is difficult for the operator to operate the slider when the operator operates the slider 910 in the X1-X2 direction.

SUMMARY

A a force-sense imparting type multidirectional input device includes: a base body that includes a receiving space; a slider that is movably disposed in the receiving space; an operating member that is integrated with the slider; a first driving member that includes a first engaging portion rotationally driven along the movement of the slider; a second driving member that includes a second engaging portion rotationally driven along the movement of the slider; and a force-sense imparting unit that imparts a sense of force to an operator through the operating member. The slider is slidingly moved along a first virtual axis and swings about the first virtual axis in a direction orthogonal to the first virtual axis, the first engaging portion of the first driving member is rotationally driven with a sliding movement of the slider, and the second engaging portion of the second driving member is rotationally driven with the swing of the slider.

According to a second aspect, in the force-sense imparting type multidirectional input device, a guide member, which includes a guide surface curved along an outer peripheral surface of a cylinder and into which the first and second engaging portions are swingably inserted from a back side of the guide surface, may be disposed in the receiving space; and the slider may include a sliding surface that is formed so as to come into surface contact with the guide surface, may be disposed so that the sliding surface and the guide surface are engaged with each other, and may slide along the guide surface.

DESCRIPTION OF THE EXEMPLARY EMBODIMENTS

A force-sense imparting type multidirectional input device 100 according to a first embodiment will be described below.

Figure 1:
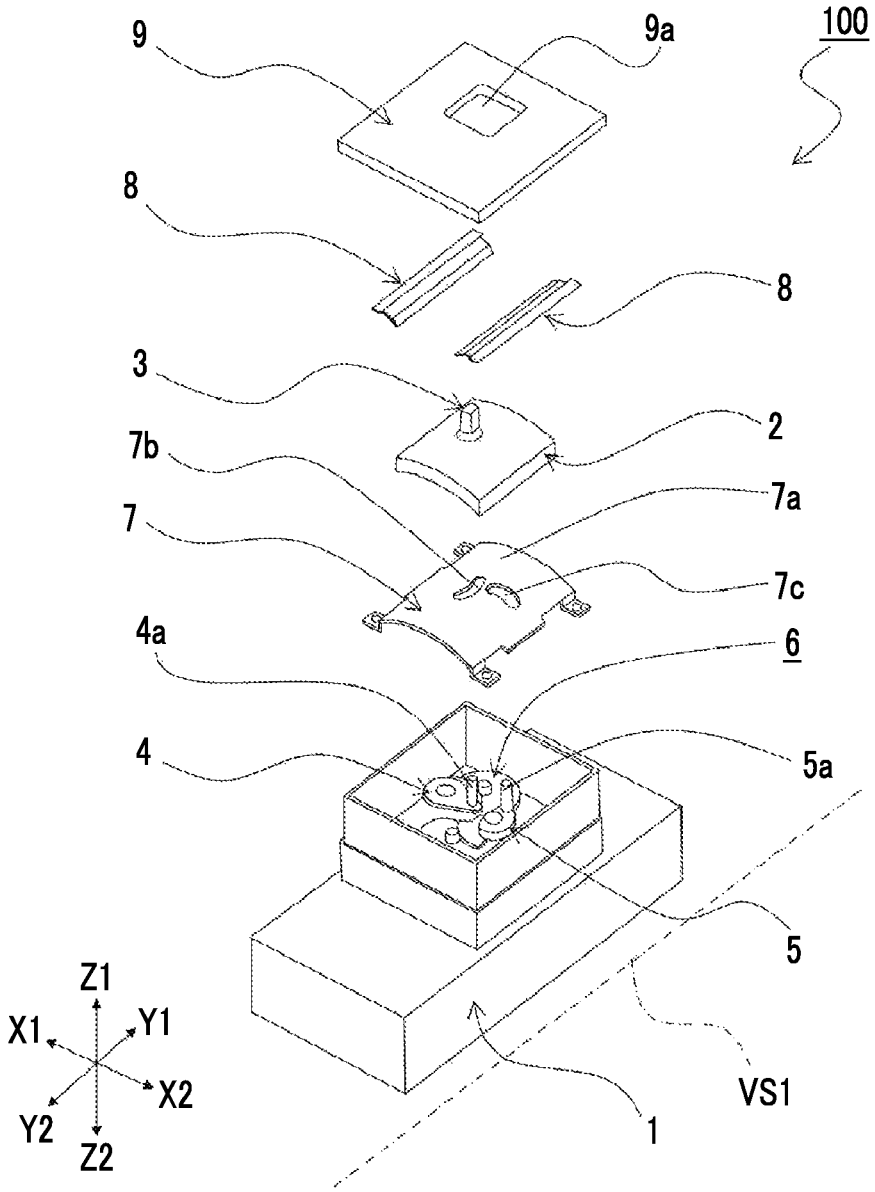
FIG. 1 is an exploded perspective view showing the structure of a force-sense imparting type multidirectional input device 100 according to a first embodiment.
Figure 2:
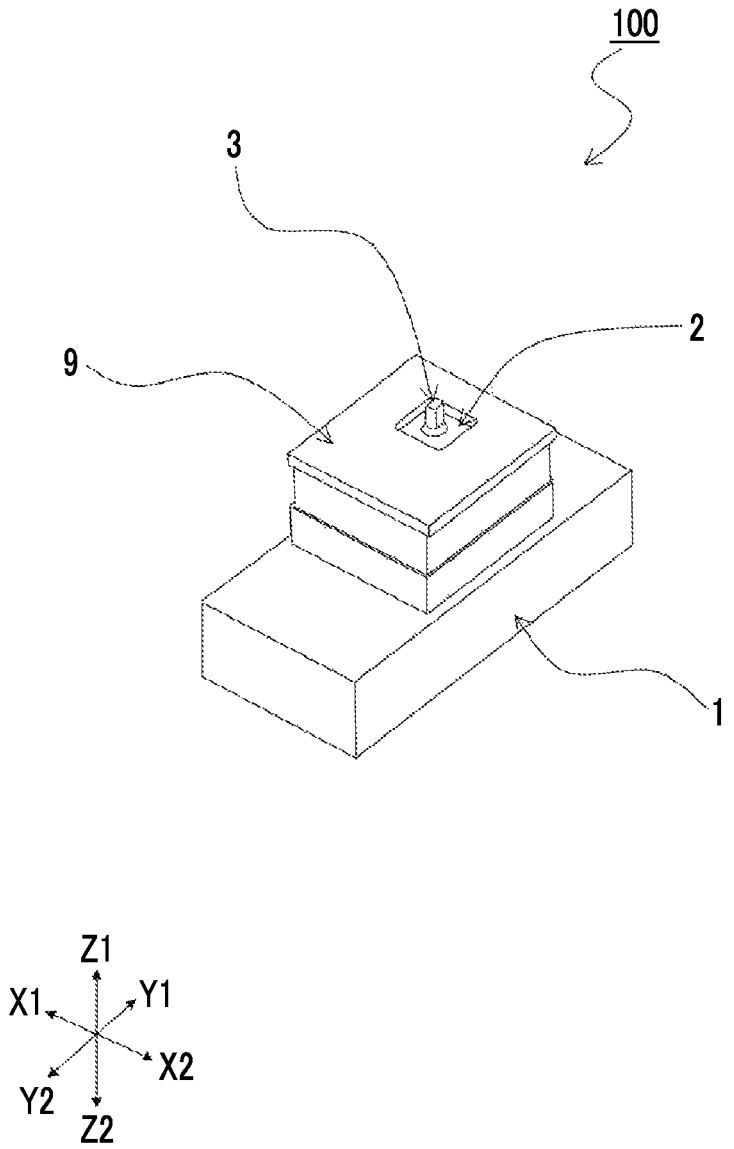
FIG. 2 is a perspective view showing the appearance of the force-sense imparting type multidirectional input device 100 according to the first embodiment.
Figure 3:
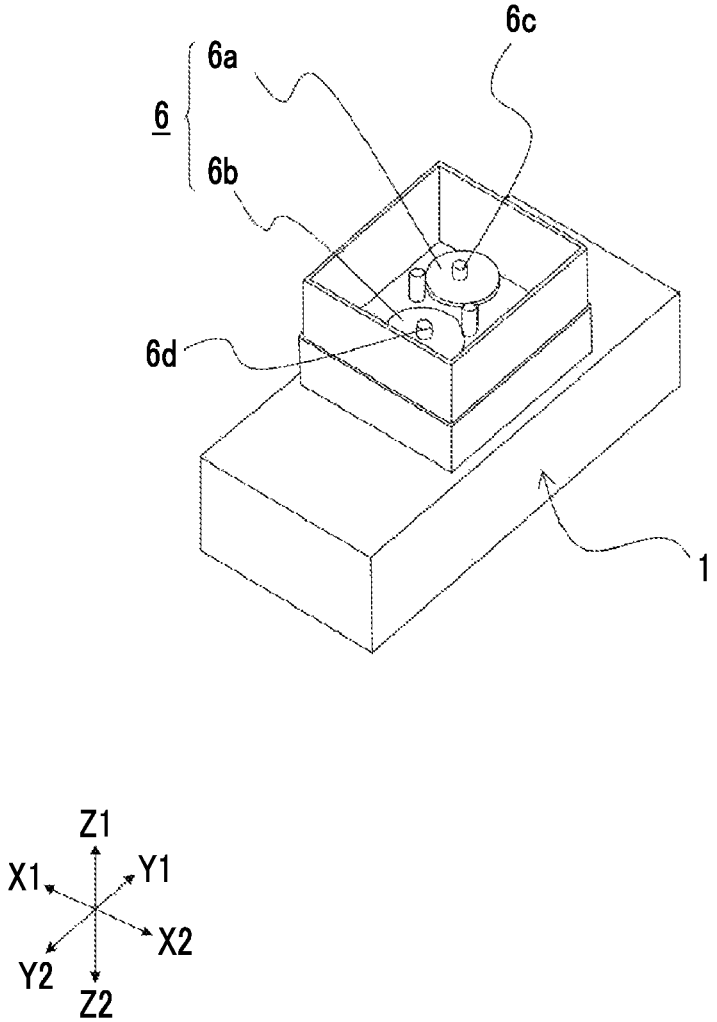
FIG. 3 is a perspective view showing the appearance of a base body 1 on which a force-sense imparting unit 6 of the first embodiment is mounted.
Figure 4A:
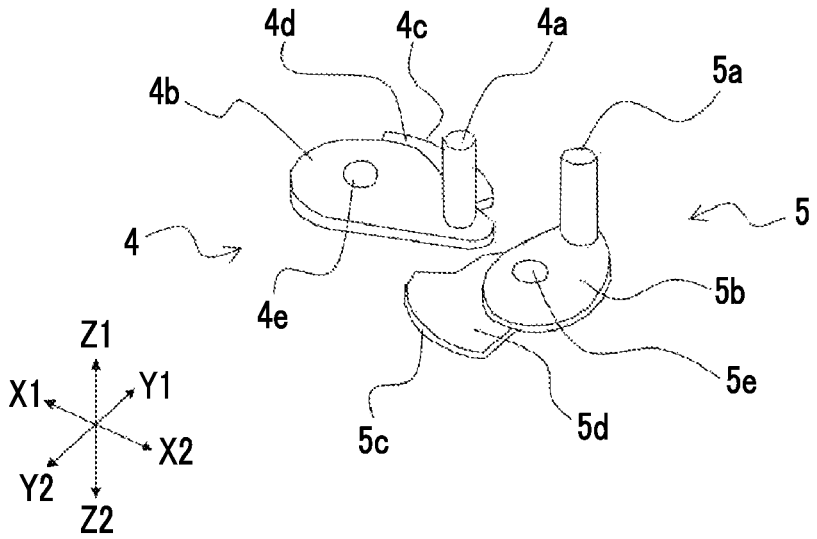
FIGS. 4A and 4B are views showing the appearances of first and second driving members 4 and 5 of the first embodiment.
Figure 4B:
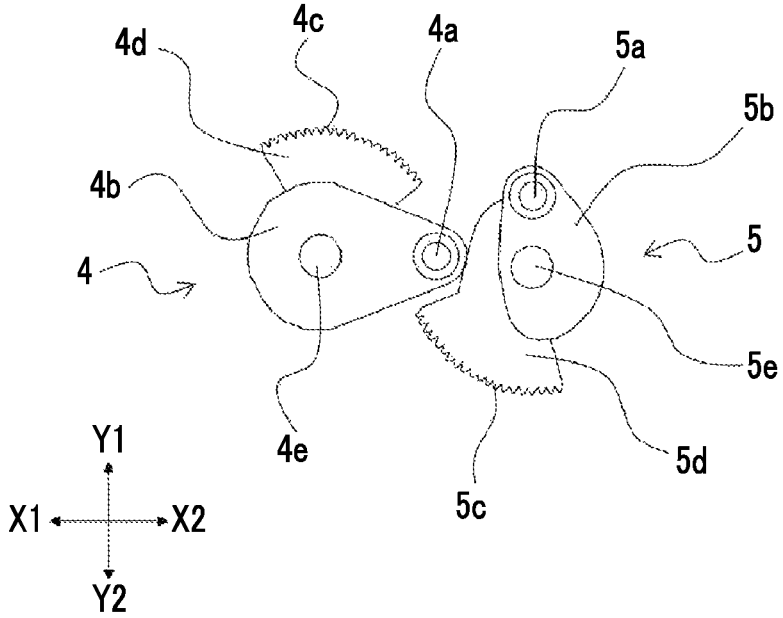
Figure 5:
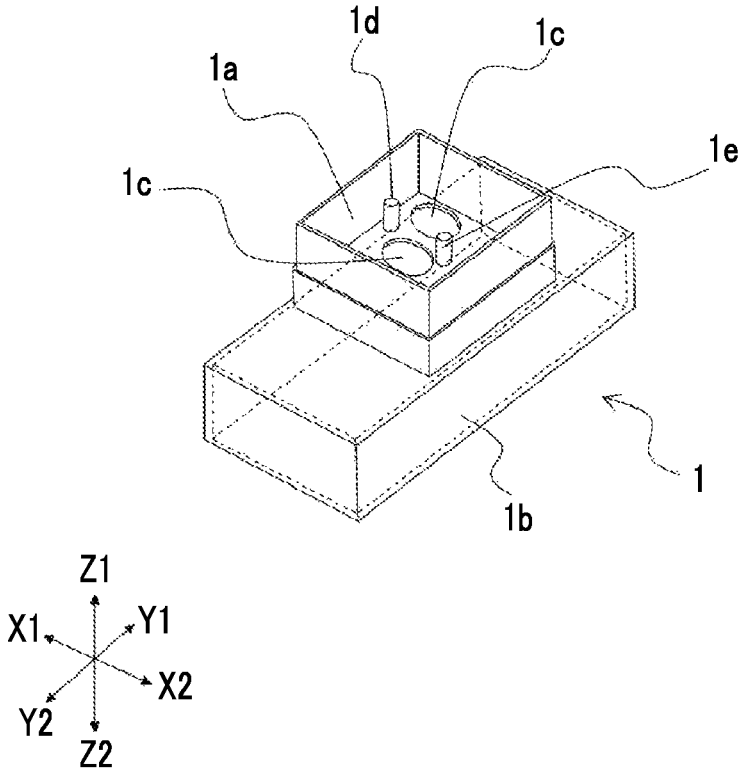
FIG. 5 is a perspective view showing the appearance of the base body 1 of the first embodiment.
Figure 6A:
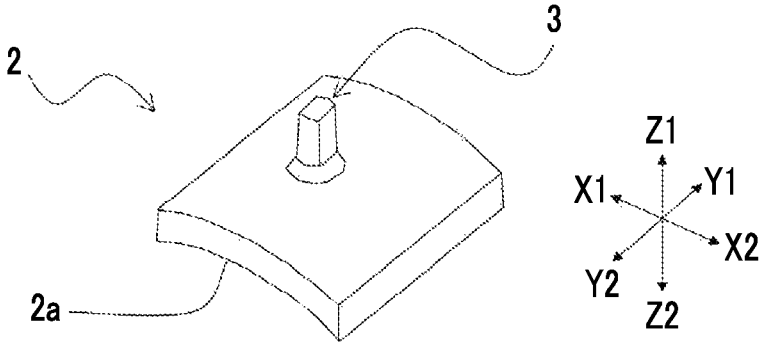
FIGS. 6A to 6C are views showing a state in which a slider 2 and an operating member 3 of the first embodiment are integrated with each other.
Figure 6B:
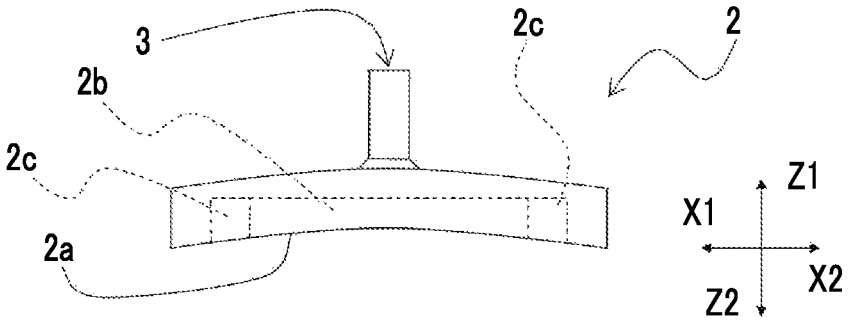
Figure 6C:
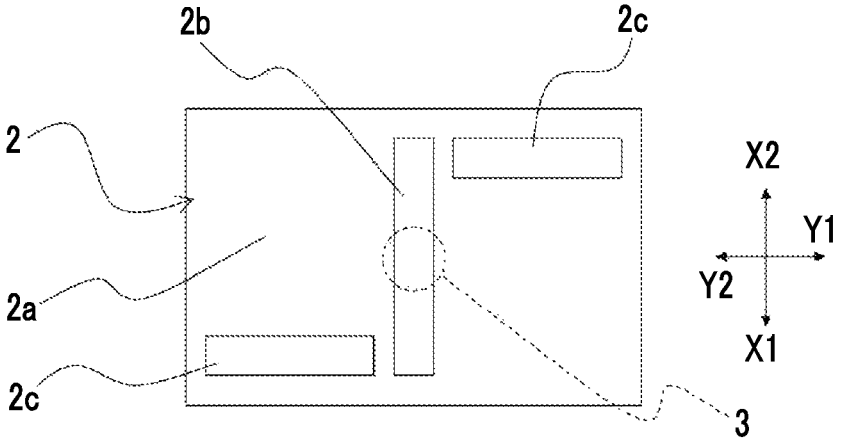

First of all, the structure of the force-sense imparting type multidirectional input device 100 according to this embodiment will be described with reference to FIGS. 1 to 6. FIG. 1 is an exploded perspective view showing the structure of the force-sense imparting type multidirectional input device 100 according to the first embodiment. FIG. 2 is a perspective view showing the appearance of the force-sense imparting type multidirectional input device 100 according to the first embodiment. FIG. 3 is a perspective view showing the appearance of a base body 1 on which a force-sense imparting unit 6 of the first embodiment is mounted. FIGS. 4A and 4B are views showing the appearances of first and second driving members 4 and 5 of the first embodiment, FIG. 4A is a perspective view showing the appearances of the first and second driving members 4 and 5, and FIG. 4B is a plan view showing the appearances of the first and second driving members 4 and 5 when seen from the side corresponding to a Z1 direction shown in FIG. 4A. FIG. 5 is a perspective view showing the appearance of the base body 1 of the first embodiment. FIGS. 6A to 6C are views showing a state in which a slider 2 and an operating member 3 of the first embodiment are integrated with each other, FIG. 6A is a perspective view showing the state in which the slider 2 and the operating member 3 are integrated with each other, FIG. 6B is a side view showing the appearances of the slider 2 and the operating member 3 when seen from the side corresponding to a Y2 direction shown in FIG. 6A, and FIG. 6C is a plan view showing the appearances of the slider 2 and the operating member 3 when seen from the side corresponding to a Z2 direction shown in FIG. 6A. Meanwhile, FIGS. 1 to 6C are schematic views, and the detailed shapes or dimensional relationships shown in FIGS. 1 to 6C may be different from those of actual objects.

As shown in FIG. 1, the force-sense imparting type multidirectional input device 100 includes a base body 1, a slider 2, an operating member 3, a first driving member 4, a second driving member 5, a force-sense imparting unit 6, a guide member 7, regulating members 8, and a cover member 9. As shown in FIG. 2, the force-sense imparting type multidirectional input device 100 is formed so that the operating member 3 provided so as to protrude outward (in a Z1 direction) can be operated. Meanwhile, for easier operation, an operating knob (not shown) or the like, which is formed so as to be easily gripped, may be mounted on a tip portion of the protruding operating member 3 when the force-sense imparting type multidirectional input device is actually used.

The detailed structure of the force-sense imparting unit 6 will be omitted, but the force-sense imparting unit 6 is a unit component in which two motors, that is, a first motor 6*a* and a second motor 6*b*, are built as shown in FIG. 3 in this embodiment. A first transmission part 6*c* (see FIG. 7) on which recesses and protrusions are formed at a predetermined pitch in the circumferential direction of a rotating shaft is disposed at a tip of the rotating shaft of the first motor 6*a*, and a second transmission part 6*d* (see FIG. 7) on which recesses and protrusions are formed at a predetermined pitch in the circumferential direction of a rotating shaft is disposed at a tip of the rotating shaft of the second motor 6*b*. The first and second motors 6*a* and 6*b* are disposed so that the first and second transmission parts 6*c* and 6*d* protrude upward (in the Z1 direction), and can be individually driven.

The first driving member 4 is made of a synthetic resin material. As shown in FIGS. 4A and 4B, the first driving member 4 includes a first driving plate 4*b* that is formed in the shape of a plate and includes a first engaging portion 4*a* and a first gear plate 4*d* that is formed in the shape of a plate and includes a first gear portion 4*c* formed at a part of the outer peripheral end surface thereof. The first driving plate 4*b* overlaps the upper surface of the first gear plate 4*d* and is locked to the upper surface of the first gear plate 4*d*, so that the first driving member 4 is formed. Further, the first driving member 4 includes a first shaft hole 4*e* that is a circular through hole passing through the first driving plate 4*b* and the first gear plate 4*d*. The first engaging portion 4*a* and the first gear portion 4*c* are disposed on different sides with respect to the first shaft hole 4*e*. Meanwhile, in this embodiment, the first engaging portion 4*a* is disposed on the side corresponding to an X2 direction and the first gear portion 4*c* is disposed on the side corresponding to a Y1 direction so that the first engaging portion 4*a* and the first gear portion 4*c* are positioned on the sides corresponding to the directions substantially orthogonal to each other with respect to the first shaft hole 4*e*. The first engaging portion 4*a* is formed in the shape of a column of which the tip portion has a hemispherical shape, and is provided so as to protrude upward (in the Z1 direction) from the first driving plate 4*b*. Furthermore, the first gear portion 4*c* is formed on the outer peripheral end surface of the first gear plate 4*d* that is formed in a circular arc shape in a plan view, includes recesses and protrusions that are formed at a predetermined pitch in the circumferential direction, and is formed so as to be capable of being engaged with the first transmission part 6*c* of the first motor 6*a*.

The second driving member 5 is made of a synthetic resin material. As shown in FIGS. 4A and 4B, the second driving member 5 includes a second driving plate 5*b* that is formed in the shape of a plate and includes a second engaging portion 5*a* and a second gear plate 5*d* that is formed in the shape of a plate and includes a second gear portion 5*c* formed at a part of the outer peripheral end surface thereof. The second driving plate 5*b* overlaps the upper surface of the second gear plate 5*d* and is locked to the upper surface of the second gear plate 5*d*, so that the second driving member 5 is formed. Further, the second driving member 5 includes a second shaft hole 5*e* that is a circular through hole passing through the second driving plate 5*b* and the second gear plate 5*d*. The second engaging portion 5*a* and the second gear portion 5*c* are disposed on different sides with respect to the second shaft hole 5*e*. Meanwhile, in this embodiment, the second engaging portion 5*a* is disposed on the side corresponding to the Y1 direction and the second gear portion 5*c* is disposed on the side corresponding to the Y2 direction with respect to the second shaft hole 5*e*. The second engaging portion 5*a* is formed in the shape of a column of which the tip portion has a hemispherical shape, and is provided so as to protrude upward (in the Z1 direction) from the second driving plate 5*b*. Furthermore, the second gear portion 5*c* is formed on the outer peripheral end surface of the second gear plate 5*d* that is formed in a circular arc shape in a plan view, includes recesses and protrusions that are formed at a predetermined pitch in the circumferential direction, and is formed so as to be capable of being engaged with the second transmission part 6*d* of the second motor 6*b*.

The base body 1 is made of a synthetic resin material, is formed in the shape of a box as shown in FIG. 5, and is hollow. The base body 1 includes a base portion 1*b* that is formed in the shape of a box of which the lower surface (the surface corresponding to a Z2 direction) is opened, and a space having a size in which the force-sense imparting unit 6 can be received is formed in the base portion 1*b*. Further, the base body 1 includes a receiving space 1*a* which is provided on the upper surface (the surface corresponding to the Z1 direction) of the base portion 1*b* and of which the four sides (the sides corresponding to the X1-X2 direction and the sides corresponding to the Y1-Y2 direction) are surrounded and the upper side is opened. Meanwhile, communication holes 1*c* are formed at the bottom of the receiving space 1*a*, so that the inside of the receiving space 1*a* and the inside of the base portion 1*b* communicate with each other through the communication holes 1*c*. Furthermore, each of the communication holes 1*c* is formed so as to have a size into which each of the first and second transmission parts 6*c* and 6*d* of the force-sense imparting unit 6 can be inserted. Moreover, a first shaft column 1*d* and a second shaft column 1*e* are formed on the bottom of the receiving space 1*a*. The first shaft column 1*d* is formed in a columnar shape, is inserted into the first shaft hole 4*e* of the first driving member 4, and can support the first driving member 4 so as to allow the first driving member 4 to swing. The second shaft column 1*e* is formed in a columnar shape, is inserted into the second shaft hole 5*e* of the second driving member 5, and can support the second driving member 5 so as to allow the second driving member 5 to swing.

The guide member 7 is made of metal, includes a guide surface 7*a* that is curved along the outer peripheral surface of a cylinder as shown in FIG. 1, and is formed so as to have a size that can be received in the receiving space 1*a* of the base body 1. A first rotating hole 7*b* into which the first engaging portion 4*a* can be inserted and a second rotating hole 7*c* into which the second engaging portion 5*a* can be inserted are formed at the guide surface 7*a*. Meanwhile, since each of the first and second rotating holes 7*b* and 7*c* is formed in a circular arc shape, the first and second engaging portions 4*a* and 5*a* can be inserted into the first and second rotating holes 7*b* and 7*c* even when the first and second engaging portions 4*a* and 5*a* swing.

The slider 2 is made of a synthetic resin material, and is formed in the shape of a rectangular plate that is curved along the outer peripheral surface of a cylinder as shown in FIGS. 6A to 6C. The lower surface (the surface corresponding to the Z2 direction) of the slider 2 includes a sliding surface 2*a* that is curved in a concave shape, and the sliding surface 2*a* is formed so as to be capable of coming into surface contact with the guide surface 7*a* of the guide member 7. A first guide groove 2*b* into which the first engaging portion 4*a* can be inserted and second guide grooves 2*c* into which the second engaging portion 5*a* can be inserted are formed on the sliding surface 2*a*. Meanwhile, the first guide groove 2*b* is formed in the shape of a groove that linearly extends in the curved direction of the sliding surface 2*a* (the X1-X2 direction). Further, the first guide groove 2*b* is disposed in the middle of the sliding surface 2*a*. The second guide grooves 2*c* are formed in the shape of a groove that linearly extends in a direction (the Y1-Y2 direction) orthogonal to the direction in which the first guide groove 2*b* extends. Meanwhile, as shown in FIG. 6C, the second guide groove 2*c* is disposed on the side corresponding to the Y2 direction on the sliding surface 2*a* so as to extend from the vicinity of a corner corresponding to the X1 direction to the vicinity of the first guide groove 2*b*. Furthermore, the second guide groove 2*c* is disposed on the side corresponding to the Y1 direction on the sliding surface 2*a* so as to extend from the vicinity of a corner corresponding to the X2 direction to the vicinity of the first guide groove 2*b*. That is, the second guide grooves 2*c* are formed at the diagonal positions of the sliding surface 2*a*, respectively.

The operating member 3 is made of a synthetic resin material, is formed in a columnar shape as shown in FIG. 6, and is integrated with the slider 2 so as to protrude upward from the center of the upper surface of the slider 2 (the back of the sliding surface 2*a*). Meanwhile, in this embodiment, the operating member 3 and the slider 2 are formed as a single member by injection molding.

The regulating members 8 are formed of metal plates, and are formed of two members that are formed in a rectangular shape as shown in FIG. 1. Further, the regulating members 8 are bent in the same direction at two points in the longitudinal direction of the rectangular shape, so that the regulating members 8 are formed in a substantially arc shape.

The cover member 9 is made of a synthetic resin material, and is formed in the shape of a flat plate that has a size capable of covering the upper portion of the receiving space 1*a*, as shown in FIG. 1. An operation opening 9*a* into which the operating member 3 can be inserted is formed near the center of the cover member 9.

Figure 7:
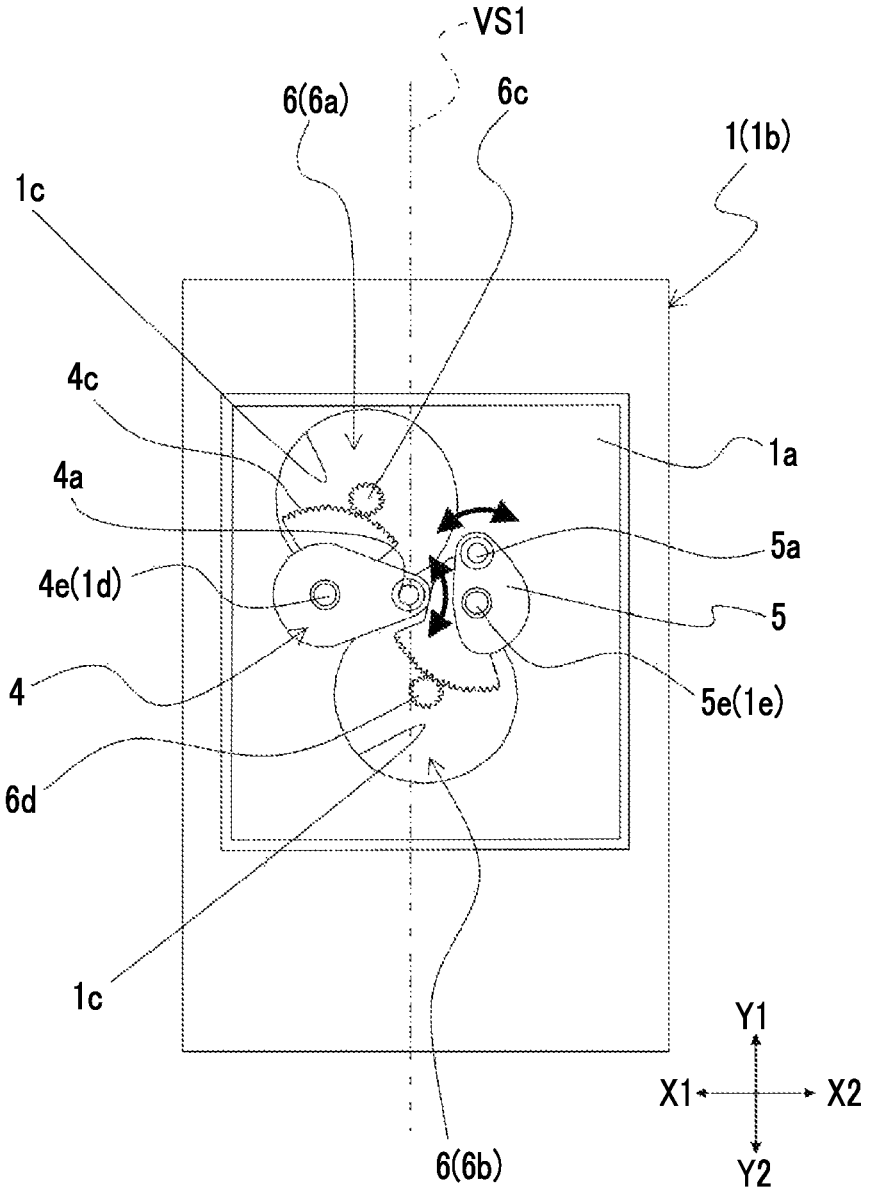
FIG. 7 is a plan view of the base body 1 on which the force-sense imparting unit 6, the first driving member 4, and the second driving member 5 shown in FIG. 1 are disposed when seen from the side corresponding to a Z1 direction.
Figure 8:
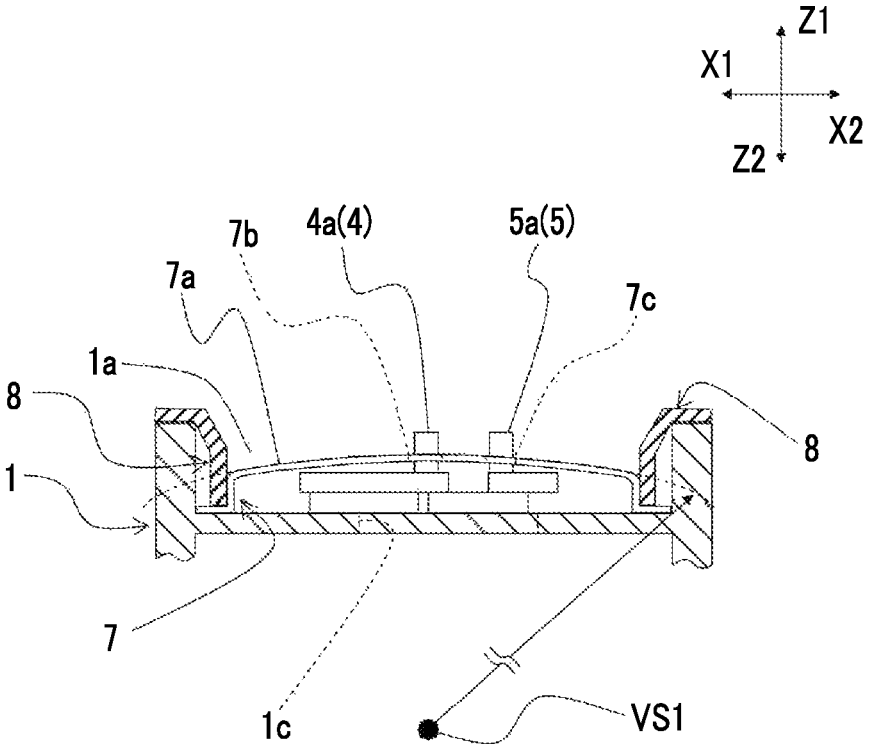
FIG. 8 is a schematic cross-sectional view of the base body 1 on which the first driving member 4, the second driving member 5, a guide member 7, and regulating members 8 of the first embodiment are disposed.
Figure 9:
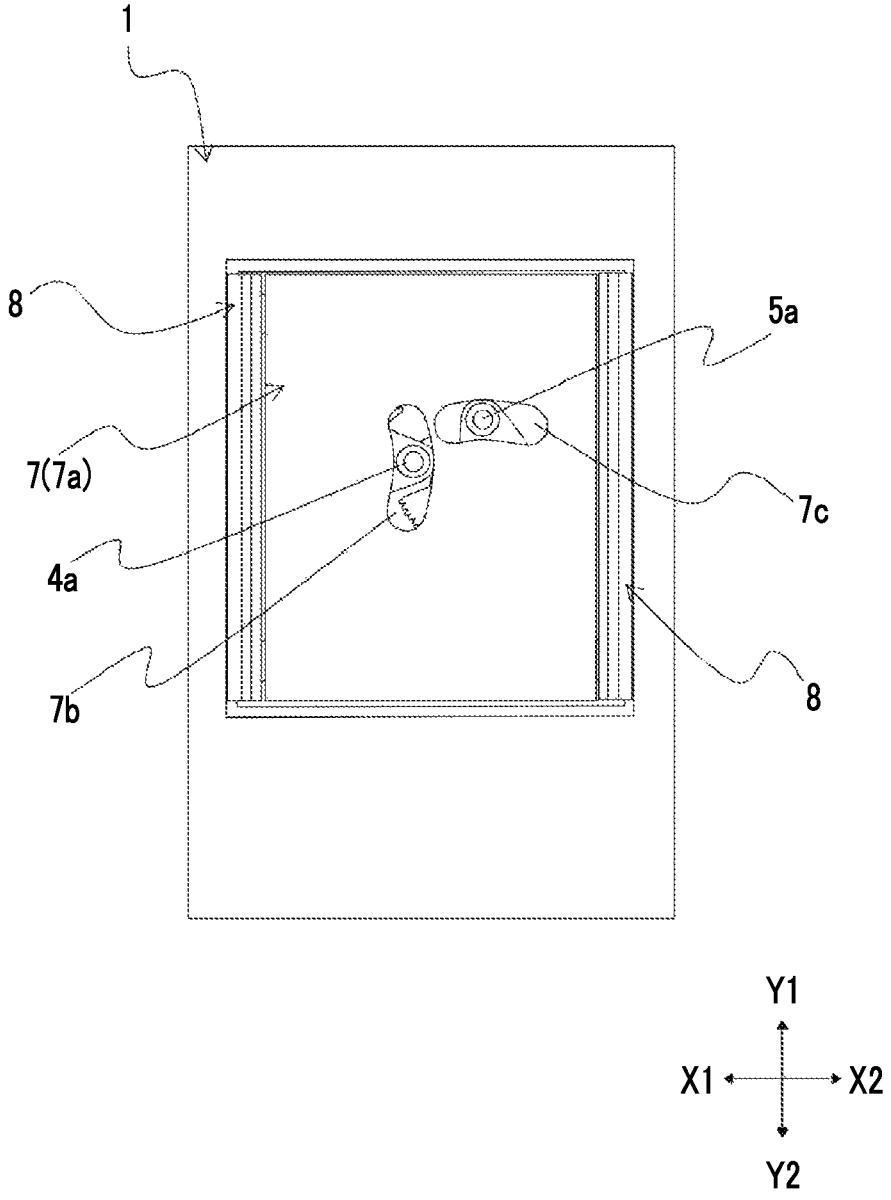
FIG. 9 is a schematic plan view showing a state in which the guide member 7 is disposed in a receiving space 1*a* in a state shown in FIG. 7.
Figure 10:
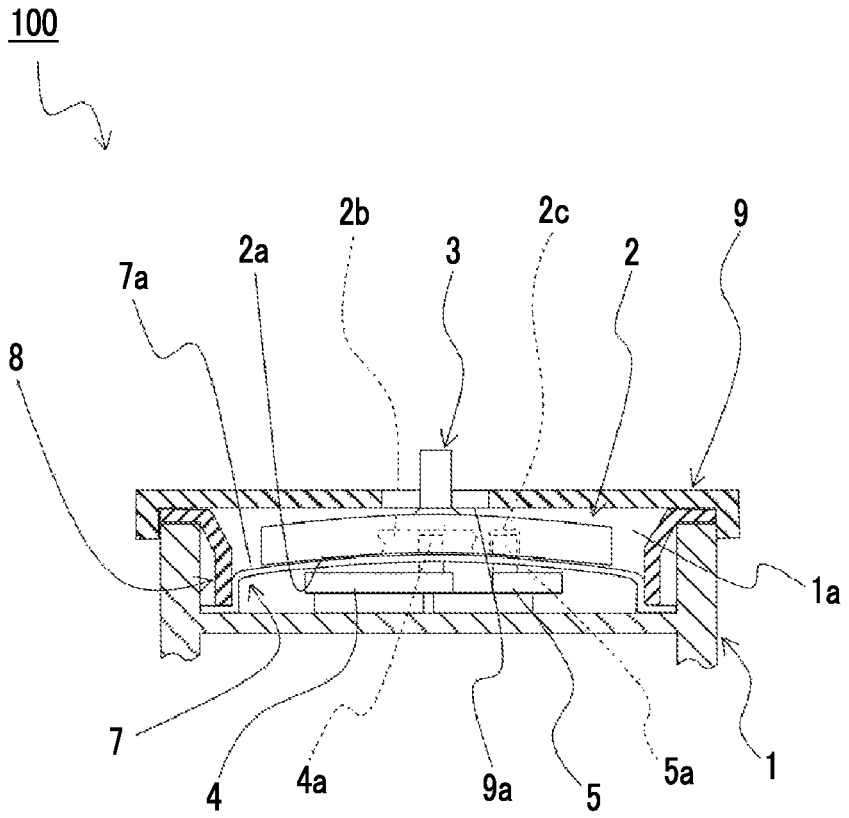
FIG. 10 is a schematic cross-sectional view showing a state in which the slider 2 and a cover member 9 are disposed in a state shown in FIG. 8.
Figure 11:
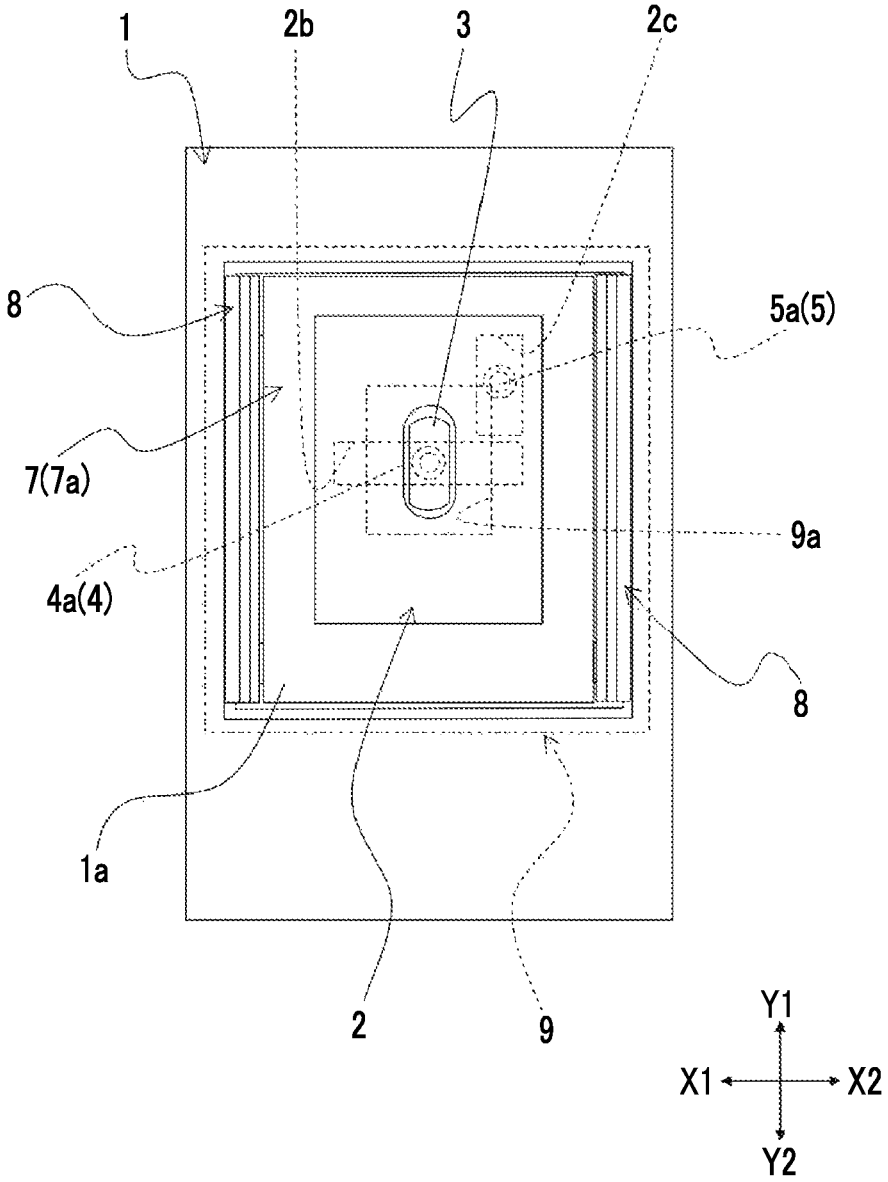
FIG. 11 is a schematic plan view showing a state in which the slider 2 and the cover member 9 are disposed in the state shown in FIG. 9.
Figure 12A:
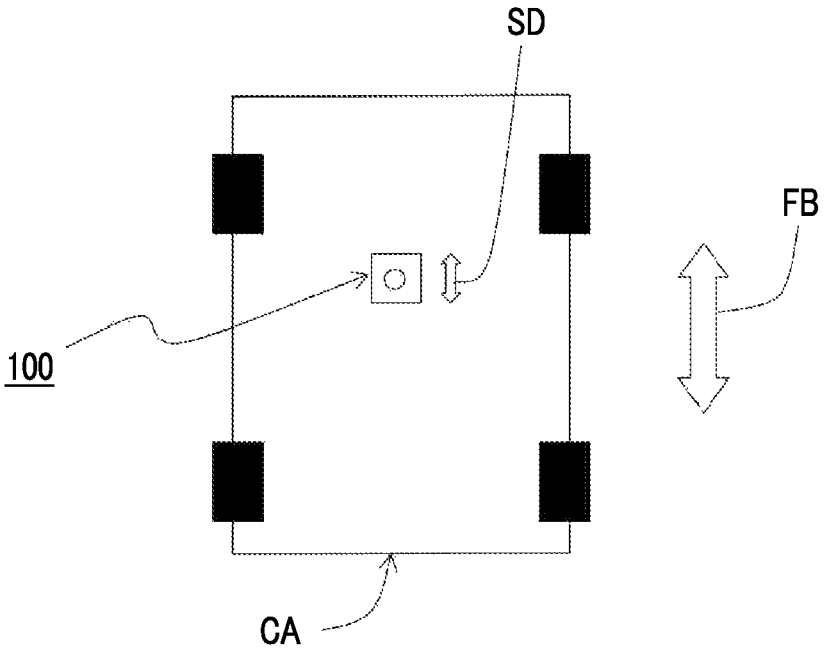
FIGS. 12A and 12B are schematic views showing a direction SD in which the slider 2 can be slidingly moved and a longitudinal direction FB of a vehicle CA.
Figure 12B:
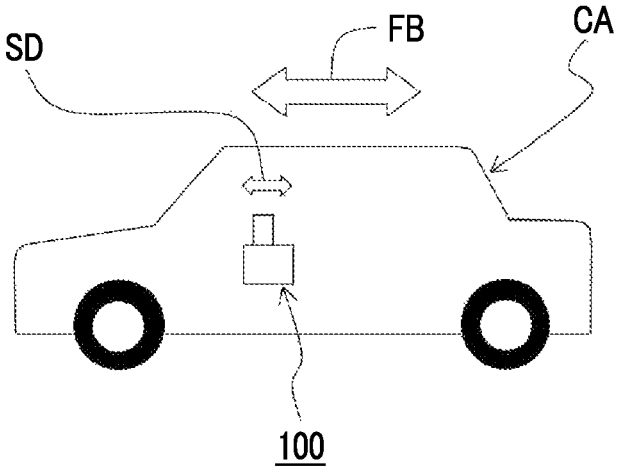

Next, the structure of the force-sense imparting type multidirectional input device 100 will be described with reference to FIGS. 7 to 12. FIG. 7 is a plan view of the base body 1 on which the force-sense imparting unit 6, the first driving member 4, and the second driving member 5 shown in FIG. 1 are disposed when seen from the side corresponding to the Z1 direction. FIG. 8 is a schematic cross-sectional view of the base body 1 on which the first driving member 4, the second driving member 5, the guide member 7, and the regulating members 8 of the first embodiment are disposed. Meanwhile, for easy description, only one communication hole 1*c* is shown in FIG. 8. FIG. 9 is a schematic plan view showing a state in which the guide member 7 and the regulating members 8 are disposed in the receiving space 1*a* shown in FIG. 7. FIG. 10 is a schematic cross-sectional view showing a state in which the slider 2 and the cover member 9 are disposed in the state shown in FIG. 8. FIG. 11 is a schematic plan view showing a state in which the slider 2 and the cover member 9 are disposed in the state shown in FIG. 9. FIGS. 12A and 12B are schematic views showing a direction SD in which the slider 2 can be slidingly moved and a longitudinal direction FB of a vehicle CA, FIG. 12A is a schematic view of the vehicle CA when seen from above, and FIG. 12B is a schematic view of the vehicle CA when seen from the side. Meanwhile, for easy description, the force-sense imparting unit 6 originally having been disposed is not shown in FIGS. 8 and 10.

As shown in FIG. 7, the force-sense imparting unit 6 is disposed in the base portion 1*b* so that the first transmission part 6*c* of the first motor 6*a* and the second transmission part 6*d* of the second motor 6*b* protrude into the receiving space 1*a* through the communication holes 1*c*, and is fixed by screwing. The first driving member 4 is disposed in the receiving space 1*a* so that the first shaft column 1*d* is inserted into the first shaft hole 4*e* and the first driving member 4 can rotate about the first shaft column 1*d*. At this time, the first engaging portion 4*a* protrudes upward (in a direction perpendicular to the surface where the communication holes 1*c* are formed), and the first gear portion 4*c* is engaged with the first transmission part 6*c* of the first motor 6*a*. Further, the second driving member 5 is disposed in the receiving space 1*a* so that the second shaft column 1*e* is inserted into the second shaft hole 5*e* and the second driving member 5 can rotate about the second shaft column 1*e*. At this time, the second engaging portion 5*a* protrudes upward, and the second gear portion 5*c* is engaged with the second transmission part 6*d* of the second motor 6*b*.

Here, as shown in FIG. 7, a first virtual axis VS1 is a virtual axis that is provided on a line parallel to the Y1-Y2 direction in the plan view of the base body 1 that is seen from the side corresponding to the Z1 direction (see FIG. 8). Further, as shown in FIG. 8, the first virtual axis VS1 is present below the surface where the communication holes 1*c* present in the receiving space 1*a* are formed (on the side corresponding to the Z2 direction).

The guide member 7 is disposed in the receiving space 1*a* in an orientation where the guide surface 7*a* forms the outer peripheral surface of a virtual column having an axis on the first virtual axis VS1, and is fixed by screwing. At this time, as shown in FIGS. 8 and 9, the first and second engaging portions 4*a* and 5*a* are inserted into the first and second rotating holes 7*b* and 7*c* from the back side of the guide surface 7*a* so that the first and second engaging portions 4*a* and 5*a* can swing. Further, the regulating members 8 are disposed in the receiving space 1*a* at both ends of an arc, which is formed by the guide surface 7*a*, so as to extend in the extending direction of the guide surface 7*a* (the Y1-Y2 direction). Furthermore, the regulating members 8 are disposed in an orientation where the sides of the regulating members 8 formed in a substantially arc shape by bending so as to be convex face the guide member 7.

As shown in FIGS. 10 and 11, the slider 2 integrated with the operating member 3 is disposed so as to overlap the guide surface 7*a* of the guide member 7 that is disposed as described above. The sliding surface 2*a* and the guide surface 7*a* of the guide member 7 are engaged with each other, and the slider 2 is disposed between the regulating members 8 in the receiving space 1*a* so that swing and the sliding movement can be performed. Meanwhile, the swing is movement along a curved surface like a part of the cylinder, which is formed by the guide surface 7*a*, in the circumferential direction of the cylinder. The sliding movement corresponds to a direction orthogonal to a swing direction. Further, when the slider 2 is disposed on the guide surface 7*a*, the first engaging portion 4*a* protruding upward (in the Z1 direction shown in FIG. 10) from the guide surface 7*a* is inserted into the first guide groove 2*b* and the second engaging portion 5*a* is inserted into the second guide grooves 2*c*.

Furthermore, as shown in FIGS. 10 and 11, the cover member 9 is disposed so as to allow the operating member 3 to be inserted into the operation opening 9*a* and so as to cover the upper portion of the receiving space 1*a* and is fixed to the base body 1 by screwing. Meanwhile, when the slider 2 swings to the end of an operation area, the slider 2 and the regulating member 8 come into contact with each other, and the operating member 3 and the operation opening 9*a* do not come into contact with each other. Moreover, when the slider 2 is slidingly moved to the end of the operation area, the slider 2 and the base body 1 come into contact with each other, and the operating member 3 and the operation opening 9*a* do not come into contact with each other. Since the cover member 9 is disposed so as to cover the upper portion of the receiving space 1*a* and is fixed to the base body 1 as described above, components disposed in the receiving space 1*a* are held in the receiving space 1*a*. Accordingly, the force-sense imparting type multidirectional input device 100 is formed. Further, although not shown, the force-sense imparting type multidirectional input device 100 includes encoders that can detect the swing angles of the first and second driving members 4 and 5. Since the encoders have a structure that can switch the conduction state and the non-conduction state of an internal circuit for every constant rotation angle, it is possible to detect the swing direction and the degree of swing of the driving members by monitoring the switching.

A state shown in FIG. 11 in which the operating member 3 is positioned at the center of the operation opening 9*a* is referred to as an initial state. In the initial state, the first engaging portion 4*a* is disposed at a midpoint position of the first guide groove 2*b* in the X1-X2 direction and the second engaging portion 5*a* is disposed at a midpoint position of the second guide groove 2*c* in the Y1-Y2 direction. Further, as shown in FIG. 7, the first gear portion 4*c* is engaged with the first transmission part 6*c* of the first motor 6*a* near the middle of the first gear portion 4*c* and the second gear portion 5*c* is engaged with the second transmission part 6*d* of the second motor 6*b* near the middle of the second gear portion 5*c*.

Furthermore, the force-sense imparting type multidirectional input device 100, which is formed as described above, is mounted on, for example, a vehicle and is used as an input device for various kinds of operation of an air conditioner or the like. When the force-sense imparting type multidirectional input device is to be mounted on a vehicle, the force-sense imparting type multidirectional input device is used while being mounted on a vehicle so that the direction SD in which the slider 2 can be slidingly moved corresponds to the longitudinal direction FB of the vehicle CA as shown in FIGS. 12A and 12B.

Figure 13A:
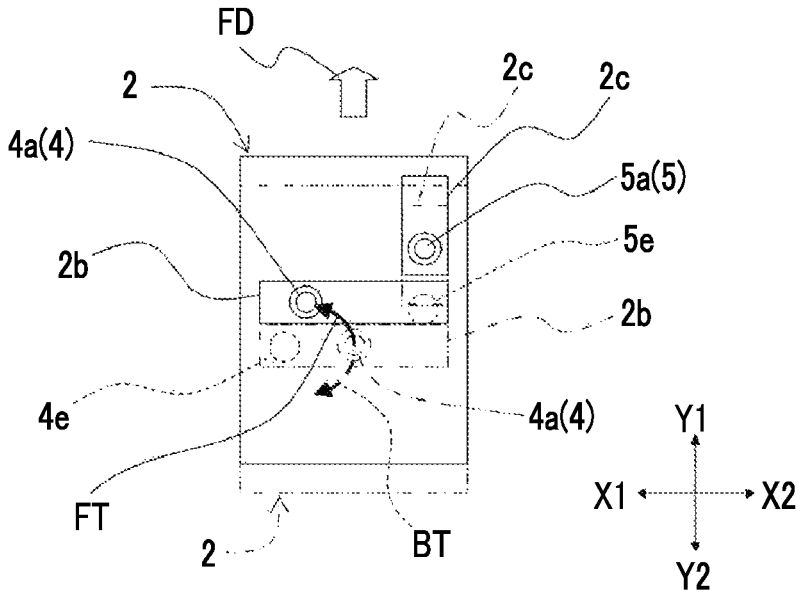
FIGS. 13A and 13B are schematic views showing the positions of first and second engaging portions 4*a* and 5*a* when the slider 2 is operated from an initial state of the first embodiment.
Figure 13B:
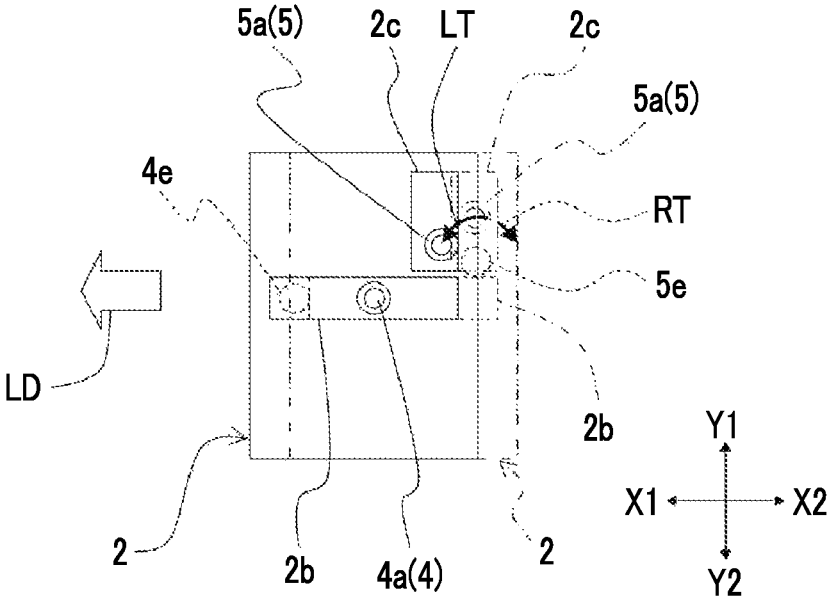

Next, the operation of the force-sense imparting type multidirectional input device 100 will be described with reference to FIG. 11 and FIGS. 13A and 13B. FIGS. 13A and 13B are schematic views showing the positions of the first and second engaging portions 4*a* and 5*a* when the slider 2 is operated from the initial state of the first embodiment, FIG. 13A is a schematic view showing the positions of the first and second engaging portions 4*a* and 5*a* when the slider slides in the Y1 direction from the initial state, and FIG. 13B is a schematic view showing the positions of the first and second engaging portions 4*a* and 5*a* when the slider swings in the X1 direction from the initial state. Meanwhile, in FIGS. 13A and 13B, the position of the slider in the initial state is shown by a two-dot chain line. Further, in FIGS. 13A and 13B, for easy description, only the slider 2, the operating member 3, and the first and second engaging portions 4*a* and 5*a* are shown and the first and second guide grooves 2*b* and 2*c* and the first and second engaging portions 4*a* and 5*a* are shown by a solid line.

As described above, the slider 2 slides along the guide surface 7*a*, can be slidingly moved along the first virtual axis VS1 (in the Y1-Y2 direction), and can swing about the first virtual axis VS1 in a direction (the X1-X2 direction) orthogonal to the first virtual axis VS1.

The slider 2 is slidingly moved from the initial state shown in FIG. 11 in a direction FD in which the slider can be slidingly moved (in the Y1 direction) by the operating member 3 (see FIG. 11) so as to be in the state shown in, for example, FIG. 13A. At this time, the first engaging portion 4*a* is inserted into the first guide groove 2*b* that is formed parallel to a direction (the X1-X2 direction) orthogonal to the direction FD. Accordingly, when the slider 2 is slidingly moved in the Y1 direction, the first engaging portion 4*a* comes into contact with the inner wall of the first guide groove 2*b* corresponding to the Y2 direction. The first engaging portion 4*a* coming into contact with the inner wall of the first guide groove 2*b* is moved in the X1 direction along the first guide groove 2*b* along the movement of the slider 2. That is, the first engaging portion 4*a* (the first driving member 4) swings about the first shaft hole 4*e* in an FT direction shown in FIG. 13A. Further, since the second engaging portion 5*a* is inserted into the second guide grooves 2*c* formed parallel to the Y1-Y2 direction, the second engaging portion 5*a* and the second guide grooves 2*c* do not come into contact with each other. For this reason, the second engaging portion 5*a* (the second driving member 5) does not swing. Furthermore, when the slider 2 is slidingly moved in a direction (the Y2 direction) opposite to the direction FD, the first engaging portion 4*a* (the first driving member 4) swings about the first shaft hole 4*e* in a BT direction opposite to the FT direction shown in FIG. 13A and the first engaging portion 4*a* is moved along the first guide groove 2*b* in the X2 direction. Moreover, the second engaging portion 5*a* (the second driving member 5) does not swing. That is, the first engaging portion 4*a* is rotationally driven with the sliding movement of the slider 2, so that the first driving member 4 swings in an FT-BT direction. Since the swing angle of the first driving member 4 is detected by the encoder (not shown) as described above, it is possible to input information about the position in the Y1-Y2 direction.

After that, the slider 2 is swung from the initial state shown in FIG. 11 in an LD direction in which the slider can swing (in the X1 direction) by the operating member 3 (see FIG. 11) so as to be in the state shown in FIG. 13B. Since the first engaging portion 4*a* is inserted into the first guide groove 2*b* formed parallel to the LD direction, that is, parallel to the X1-X2 direction, the first engaging portion 4*a* and the first guide groove 2*b* do not come into contact with each other. For this reason, the first driving member 4 does not swing. At this time, the second engaging portion 5*a* is inserted into the second guide grooves 2*c* that are formed parallel to the Y1-Y2 direction. Accordingly, when the slider 2 is swung in the LD direction (the X1 direction), the second engaging portion 5*a* comes into contact with the inner wall of the second guide groove 2*c*. The second engaging portion 5*a* coming into contact with the inner wall of the second guide groove 2*c* is moved in the Y2 direction along the second guide groove 2*c* with the swing of the slider 2. That is, the second engaging portion 5*a* (the second driving member 5) swings about the second shaft hole 5*e* in an LT direction shown in FIG. 13B. Further, when the slider 2 is swung in a direction (the X2 direction) opposite to the LD direction, the first engaging portion 4*a* (the first driving member 4) does not swing and the second engaging portion 5*a* (the second driving member 5) swings in an RT direction opposite to the LT direction. That is, the second engaging portion 5*a* is rotationally driven with the swing of the slider 2, so that the second engaging portion 5*a* (the second driving member 5) swings in an LT-RT direction. Since the swing angle of the second driving member 5 is detected by the encoder (not shown) as described above, it is possible to input information about the position in the X1-X2 direction.

Since the swing angle of the first driving member 4 and the swing angle of the second driving member 5 are detected in this way, it is possible to input information about the position in an X-Y plane that is formed by an X1-X2 direction axis and a Y1-Y2 direction axis. For example, when the force-sense imparting type multidirectional input device is used as an operation input device of a car navigation system, it is possible to use the force-sense imparting type multidirectional input device to move a cursor to select an icon displayed on a display screen.

Furthermore, the first gear portion 4*c* of the first driving member 4 is engaged with the first transmission part 6*c* of the first motor 6*a*, and the second gear portion 5*c* of the second driving member 5 is engaged with the second transmission part 6*d* of the second motor 6*b*. For this reason, when the first and second motors 6*a* and 6*b* are driven, power is applied from the force-sense imparting unit 6. Accordingly, it is possible to individually and rotationally drive the first and second engaging portions 4*a* and 5*a*. Moreover, since an operator applies a force through the operating member 3 in a direction where the operator wants to move the slider 2 or a direction opposite to the operation by individually and rotationally driving the first and second engaging portions 4*a* and 5*a*, a sense of force can be imparted to the operator through the operating member 3.

The effect of this embodiment will be described below.

The force-sense imparting type multidirectional input device 100 according to this embodiment includes the base body 1 that includes the receiving space 1*a*, the slider 2 that is movably disposed in the receiving space 1*a*, the operating member 3 that is integrated with the slider 2, the first driving member 4 that includes the first engaging portion 4*a* rotationally driven along the movement of the slider 2, the second driving member 5 that includes the second engaging portion 5*a* rotationally driven along the movement of the slider 2, and the force-sense imparting unit 6 that can impart a sense of force to an operator through the operating member 3. The slider 2 can be slidingly moved along the first virtual axis VS1 and can swing about the first virtual axis VS1 in a direction orthogonal to the first virtual axis VS1, the first engaging portion 4*a* of the first driving member 4 is rotationally driven with the sliding movement of the slider 2, and the second engaging portion 5*a* of the second driving member 5 is rotationally driven with the swing of the slider 2.

Accordingly, the slider 2 can be slidingly moved along the first virtual axis VS1 and can swing about the first virtual axis VS1 in the direction orthogonal to the first virtual axis VS1. Since the force-sense imparting type multidirectional input device 100 is disposed so as to correspond to a direction in which the slider 2 can swing and an operating direction in which an operator easily operates the slider by rotating the wrist, the slider 2 swings according to the motion of a hand caused by the rotation of the wrist of the operator. Accordingly, an effect of providing the force-sense imparting type multidirectional input device, which is easy to operate, is obtained.

Further, in the force-sense imparting type multidirectional input device 100 according to this embodiment, the guide member 7 which includes the guide surface 7*a* curved along the outer peripheral surface of a cylinder and into which the first and second engaging portions 4*a* and 5*a* can be swingably inserted from the back side of the guide surface 7*a* is disposed in the receiving space 1*a*; and the slider 2 includes the sliding surface 2*a* that can come into surface contact with the guide surface 7*a*, is disposed so that the sliding surface 2*a* and the guide surface 7*a* are engaged with each other, and slides along the guide surface 7*a*.

Accordingly, the guide member 7 includes the guide surface 7*a* that is curved along the outer peripheral surface of a cylinder, the slider 2 includes the sliding surface 2*a* that is formed so as to be capable of coming into surface contact with the guide surface 7*a*, and the slider 2 is disposed so that the guide surface 7*a* and the sliding surface 2*a* are engaged with each other and slides along the guide surface 7*a*. According to this structure, the slider 2 can swing in the circumferential direction of the guide surface 7*a* and can be slidingly moved in the extending direction of the guide surface 7*a* orthogonal to the circumferential direction of the guide surface 7*a*. Accordingly, since the slider 2 can be swung according to the motion of a hand, which causes the rotation of the wrist of an operator, in the operating direction in which the operator easily operates the slider by rotating the wrist, it is possible to provide a force-sense imparting type multidirectional input device that is easy to operate.

Further, the slider is disposed so that the sliding surface 2*a* of the slider 2 and the guide surface 7*a* of the guide member 7 are engaged with each other as described above. Accordingly, even when the slider 2 not only swings but also slides, the slider 2 is guided in the operating direction by the guide member 7. Accordingly, since it is possible to prevent the slider 2 from rotating about the operating member 3 during the operation of the slider 2, the slider 2 smoothly operates. Therefore, an effect of providing the force-sense imparting type multidirectional input device, which is easy to operate, is obtained.

Furthermore, the force-sense imparting type multidirectional input device 100 according to this embodiment is mounted on a vehicle so that the direction in which the slider 2 can be slidingly moved corresponds to the longitudinal direction FB of the vehicle.

Accordingly, since the force-sense imparting type multidirectional input device is disposed so that the direction SD in which the slider 2 can be slidingly moved corresponds to the longitudinal direction FB of the vehicle when the force-sense imparting type multidirectional input device is mounted on the vehicle, the slider 2 can be swung according to the motion of a hand, which causes the rotation of the wrist of an operator, in the operating direction in which the operator easily operates the slider by rotating the wrist. Therefore, an effect of providing the force-sense imparting type multidirectional input device, which is easy to operate when mounted on a vehicle, is obtained.

Further, the force-sense imparting type multidirectional input device 100 according to this embodiment is adapted so that power is applied from the force-sense imparting unit 6 and the first and second engaging portions 4*a* and 5*a* of the first and second driving members 4 and 5 can be individually and rotationally driven.

Accordingly, since it is possible to individually and rotationally drive the first and second engaging portions 4*a* and 5*a* by the force-sense imparting unit 6, it is possible to regulate an operation by applying a reaction force (by imparting a sense of force) to the operation of an operator. Therefore, it is possible to prevent an operator's erroneous operation by regulating an operable direction according to use. In particular, when the force-sense imparting type multidirectional input device is mounted on a vehicle, an operator can operate the force-sense imparting type multidirectional input device without turning one's eyes very far away from the traveling direction of the vehicle. Accordingly, it is possible to provide a force-sense imparting type multidirectional input device that is easier to operate when mounted on a vehicle.

Furthermore, in the force-sense imparting type multidirectional input device 100 according to this embodiment, the regulating members 8 are disposed at both ends of the arc, which formed by the guide surface 7*a*, so as to extend in the extending direction of the guide surface 7*a*.

Accordingly, since the regulating members 8 are provided, it is possible to make an operator perceive through feeling that the slider reaches the end of an operation area by making the slider 2 come into contact with the regulating members 8 even when a tilt angle caused by a sense of force, which is unexpectedly or intentionally imparted by the force-sense imparting unit 6, is not regulated. Therefore, an effect of preventing damage caused by an excessive operation is obtained.

A force-sense imparting type multidirectional input device 200 according to a second embodiment will be described below. The force-sense imparting type multidirectional input device 200 according to the second embodiment is different from the force-sense imparting type multidirectional input device 100 according to the first embodiment in terms of a structure that guides the sliding movement and the swing of the slider 2, and is the same as the force-sense imparting type multidirectional input device 100 according to the first embodiment in terms of a method of detecting an input and a method of imparting a sense of force. In the following description, components having the same functions as the components of the force-sense imparting type multidirectional input device 100 according to the first embodiment will be described using the same names as the components of the force-sense imparting type multidirectional input device 100 according to the first embodiment. Further, when exactly the same components as the components of the force-sense imparting type multidirectional input device 100 according to the first embodiment are used, the same names of the components, the same names of the portions, and the same reference numerals are also used and the detailed description thereof will be omitted.

Figure 14:
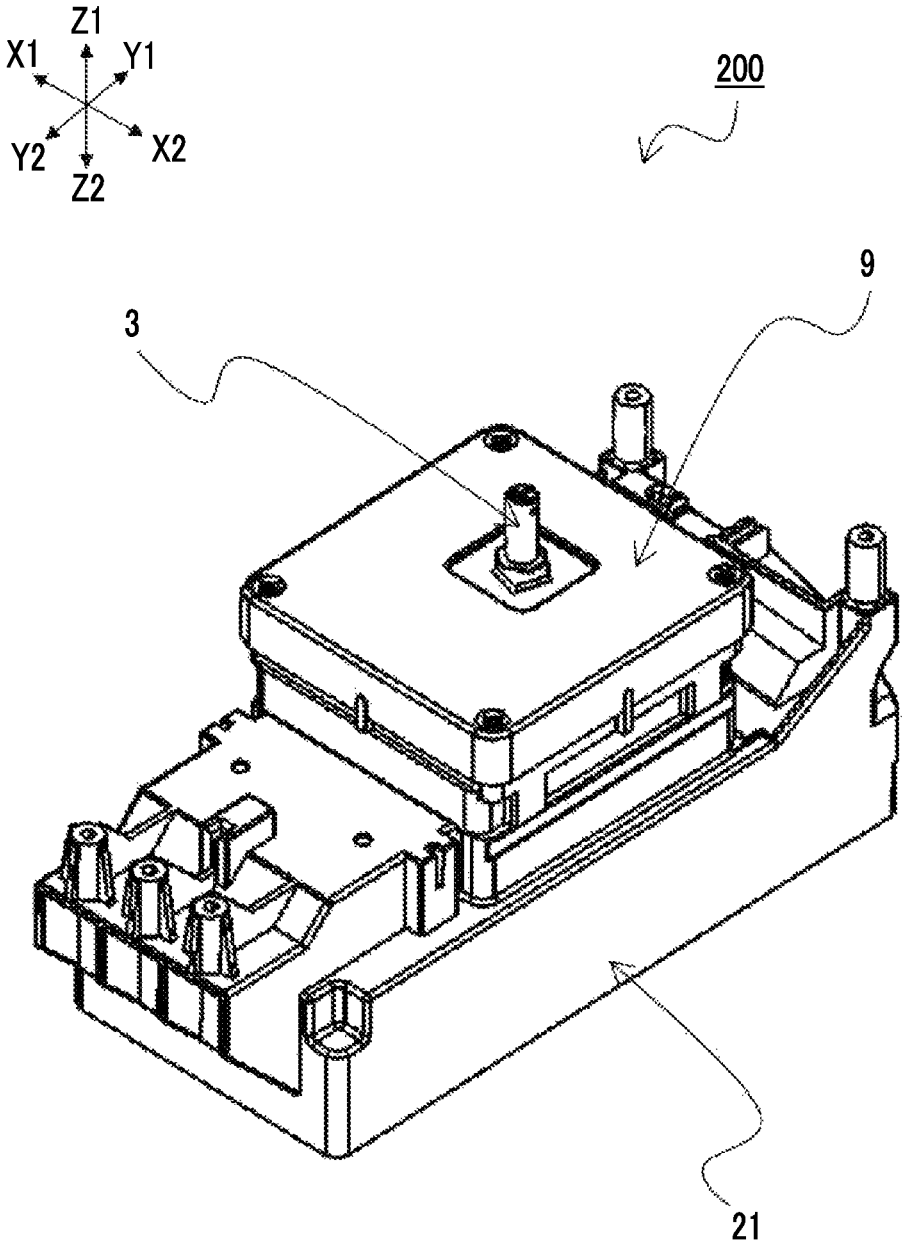
FIG. 14 is a perspective view showing the appearance of a force-sense imparting type multidirectional input device 200 according to a second embodiment.
Figure 15:
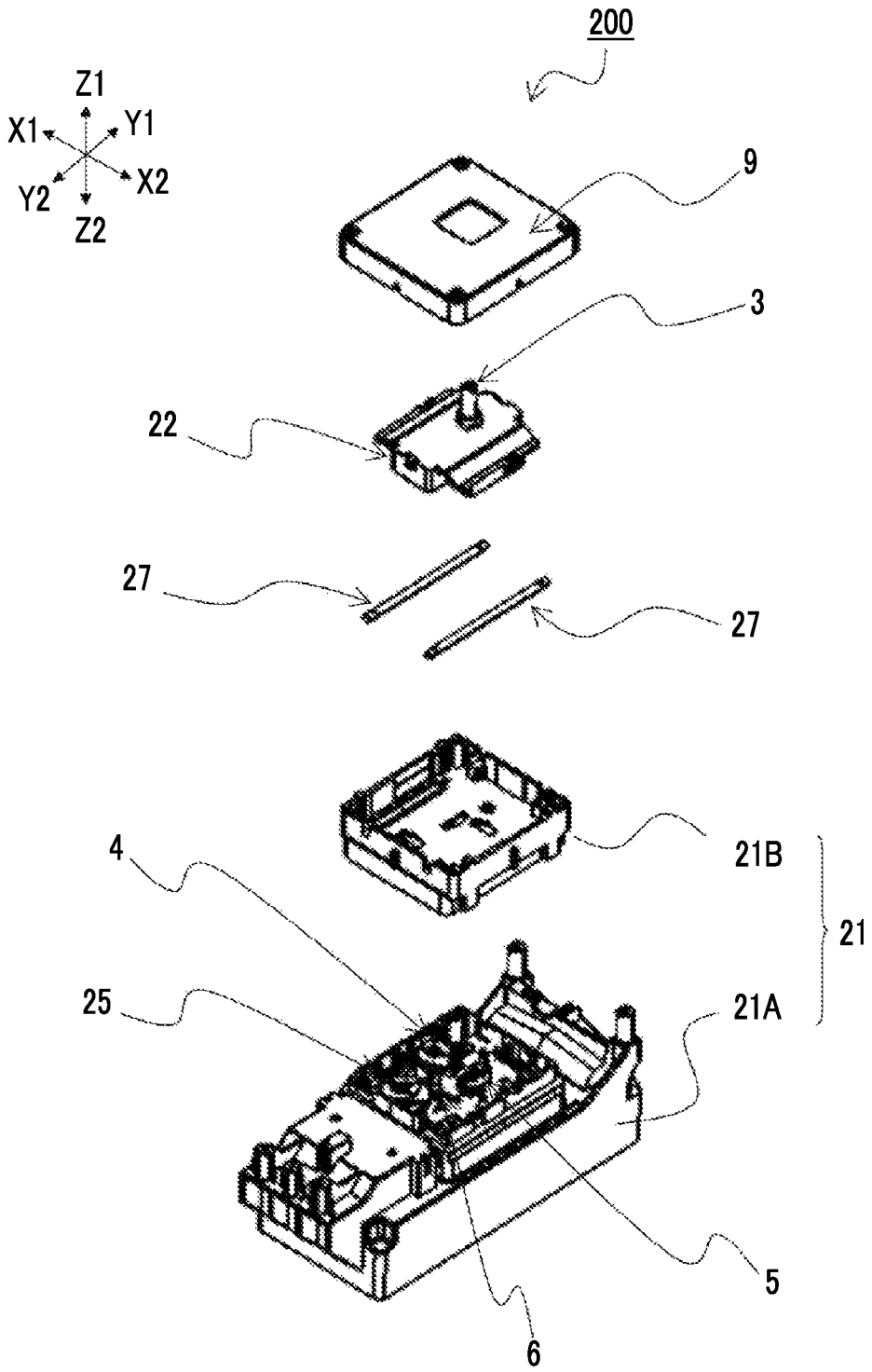
FIG. 15 is an exploded perspective view showing the structure of the force-sense imparting type multidirectional input device 200 according to the second embodiment.
Figure 16:
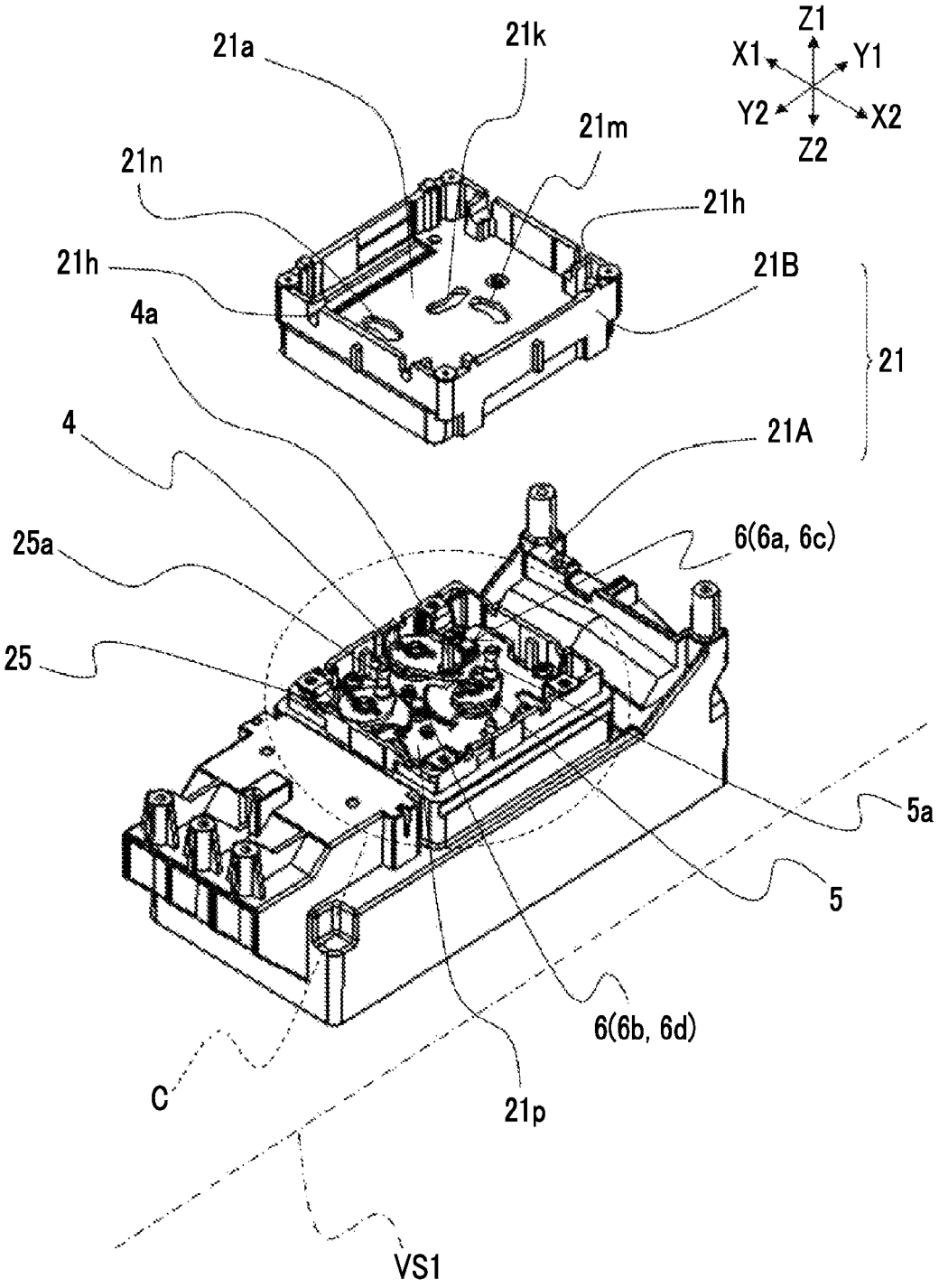
FIG. 16 is a partially exploded perspective view showing the appearance of a base body 21 on which a first driving member 4, a second driving member 5, a third driving member 25, and a force-sense imparting unit 6 are mounted.
Figure 17A:
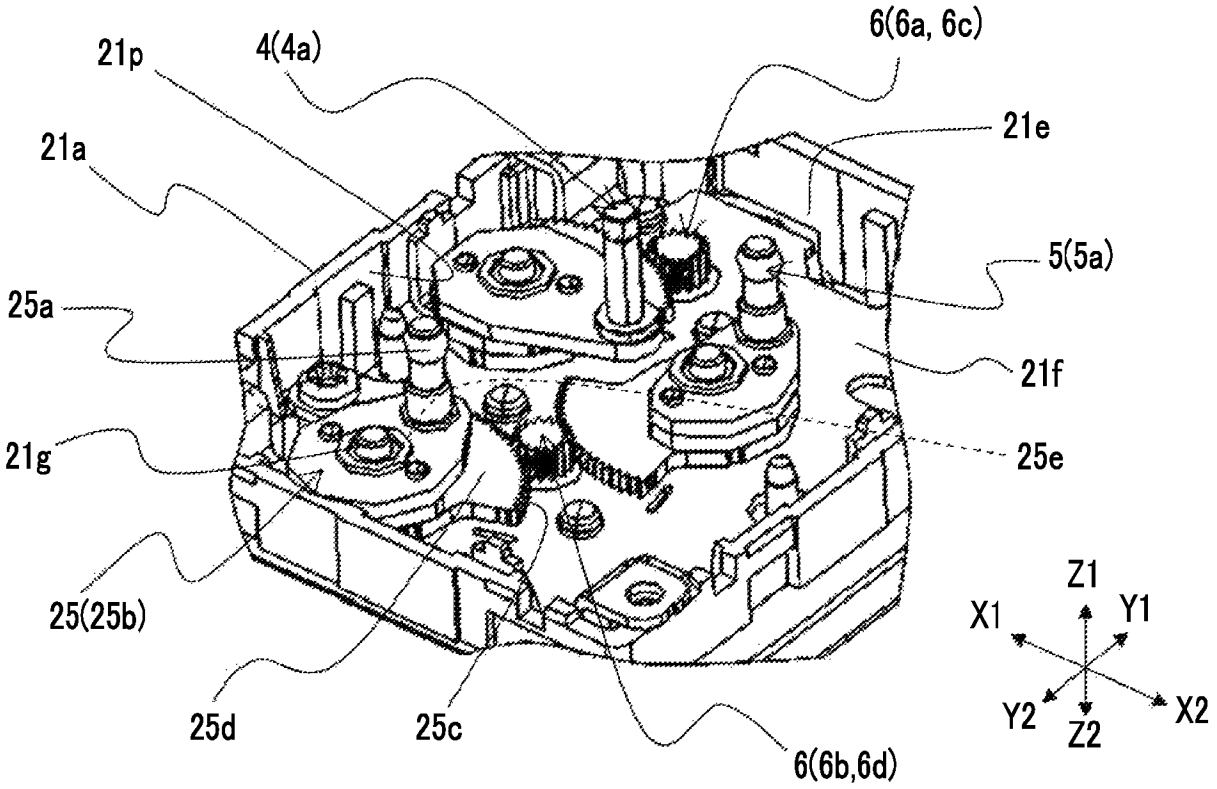
FIGS. 17A and 17B are enlarged views of a portion C shown in FIG. 16.
Figure 17B:
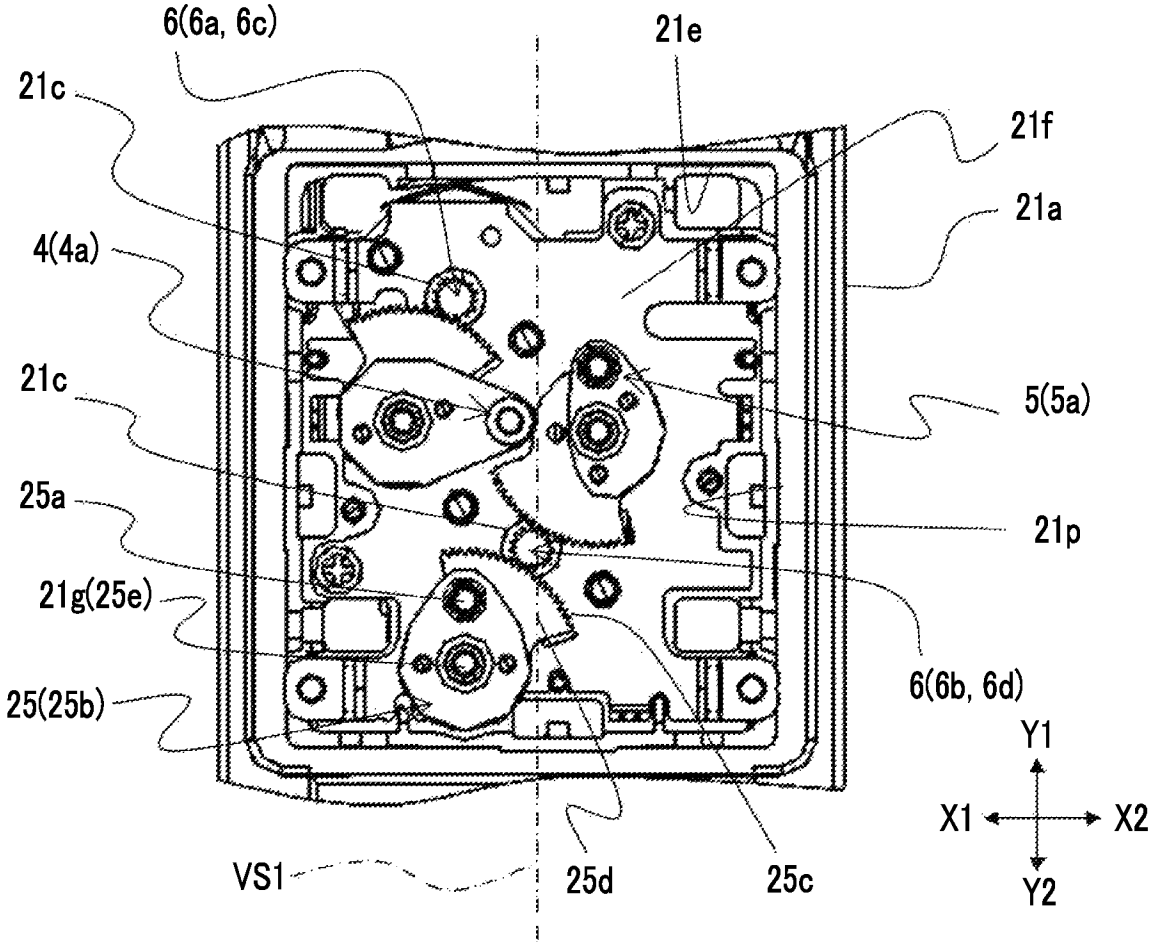
Figure 18A:
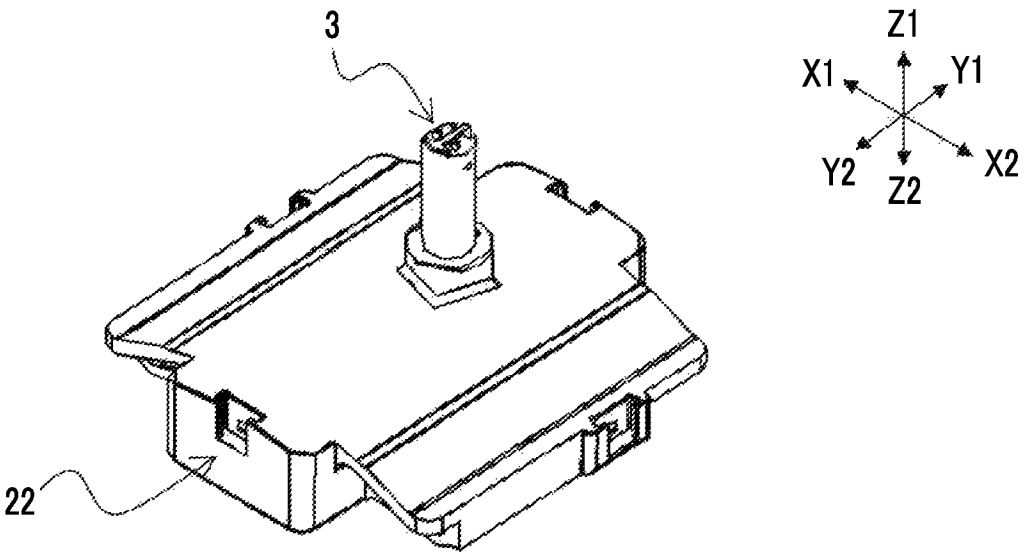
FIGS. 18A to 18C are views showing the appearance of a slider 22 of the second embodiment.
Figure 18B:
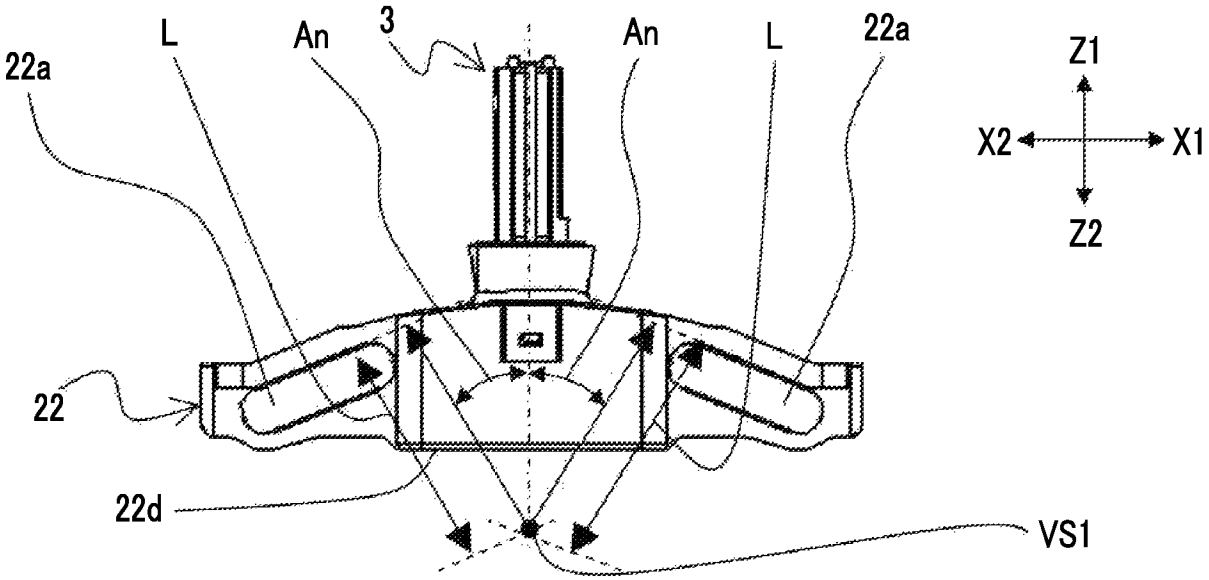
Figure 18C:
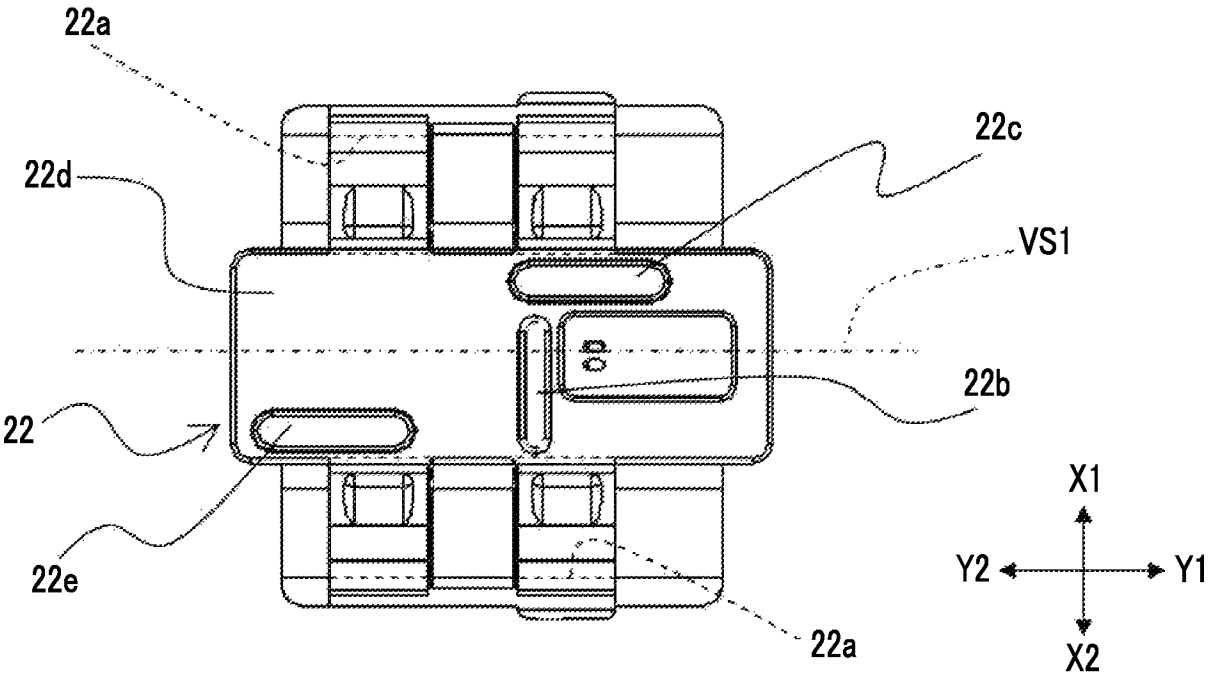

First of all, the structure of the force-sense imparting type multidirectional input device 200 will be described with reference to FIG. 14 to FIGS. 18A and 18B. FIG. 14 is a perspective view showing the appearance of the force-sense imparting type multidirectional input device 200 according to the second embodiment. FIG. 15 is an exploded perspective view showing the structure of the force-sense imparting type multidirectional input device 200 according to the second embodiment. FIG. 16 is a partially exploded perspective view showing the appearance of a base body 21 on which a first driving member 4, a second driving member 5, a third driving member 25, and a force-sense imparting unit 6 are mounted. FIGS. 17A and 17B are enlarged views of a portion C shown in FIG. 16, FIG. 17A is an enlarged perspective view of the portion C, and FIG. 17B is an enlarged plan view of the portion C. FIGS. 18A to 18C are views showing the appearance of a slider 22 of the second embodiment, FIG. 18A is a perspective view showing the appearance of the slider 22, FIG. 18B is a side view of the slider 22 when seen from the side corresponding to a Y1 direction shown in FIG. 18A, and FIG. 18C is a plan view of the slider 22 when seen from the side corresponding to a Z2 direction shown in FIG. 18A.

As shown in FIG. 15, the force-sense imparting type multidirectional input device 200 includes the base body 21, the slider 22, an operating member 3, the first driving member 4, the second driving member 5, the third driving member 25, the force-sense imparting unit 6, guide members 27, and a cover member 9. Like the force-sense imparting type multidirectional input device 100 (see FIG. 2) according to the first embodiment, as shown in FIG. 14, the force-sense imparting type multidirectional input device 200 is formed so that the operating member 3 provided so as to protrude outward (in a Z1 direction) can be operated.

Since the operating member 3, the first driving member 4, the second driving member 5, and the force-sense imparting unit 6 are the same as the components of the force-sense imparting type multidirectional input device 100 according to the first embodiment, the detailed description thereof will be omitted.

The third driving member 25 is made of a synthetic resin material. As shown in FIGS. 17A and 17B, the third driving member 25 includes a third driving plate 25*b* that is formed in the shape of a plate and includes a third engaging portion 25*a* and a third gear plate 25*d* that is formed in the shape of a plate and includes a third gear portion 25*c* formed at a part of the outer peripheral end surface thereof. The third driving plate 25*b* overlaps the upper surface of the third gear plate 25*d* and is locked to the upper surface of the third gear plate 25*d*, so that the third driving member 25 is formed. Further, the third driving member 25 includes a third shaft hole 25*e* that is a circular through hole passing through the third driving plate 25*b* and the third gear plate 25*d*. The third engaging portion 25*a* and third gear portion 25*c* are disposed on substantially the same side with respect to the third shaft hole 25*e*. Meanwhile, in this embodiment, the third engaging portion 25*a* and the third gear portion 25*c* are disposed on the side corresponding to the Y1 direction with respect to the third shaft hole 25*e*. The third engaging portion 25*a* is formed in the shape of a column of which the tip portion has a hemispherical shape, and is provided so as to protrude upward (in the Z2 direction) from the third driving plate 25*b*. Furthermore, the third gear portion 25*c* is formed on the outer peripheral end surface of the third gear plate 25*d* that is formed in a circular arc shape in a plan view, includes recesses and protrusions that are formed at the same pitch as the pitch of the second gear portion 5*c* of the second driving member 5 in a circumferential direction, and is formed so as to be capable of being engaged with the second transmission part 6*d* of the second motor 6*b*.

The guide member 27 is made of a metal material, and is formed in the shape of a column (rod) as shown in FIG. 15. Meanwhile, two guide members 27 are used.

The base body 21 is made of a synthetic resin material, and includes a lower case 21A and an upper case 21B that are formed in the shape of a box and are hollows as shown in FIG. 16. Further, the base body 21 is formed so as to extend in a direction along a first virtual axis VS1 in the plan view of the base body 21 as shown in FIG. 17B, and a direction along the first virtual axis VS1 corresponds to a Y1-Y2 direction shown in FIG. 16 and FIGS. 17A and 17B.

The lower case 21A includes a base portion 21*b* that is formed in the shape of a box of which the lower surface (the surface corresponding to a Z2 direction) is opened, and a space having a size which can accommodate the force-sense imparting unit 6 is formed in the base portion 21*b*. Further, the base body 21 includes a mounting space 21*p* which is provided on the upper surface (the surface corresponding to the Z1 direction) of the base portion 21*b* and of which the four sides (the sides corresponding to the X1-X2 direction and the sides corresponding to the Y1-Y2 direction) are surrounded and the upper side is opened. Meanwhile, as shown in FIGS. 17A and 17B, communication holes 21*c* are formed in a mounting plate 21*f* forming the bottom of the mounting space 21*p*, so that the inside of the mounting space 21*p* and the inside of the base portion 21*b* communicate with each other through the communication holes 21*c*. Furthermore, each of the communication holes 21*c* is formed so as to have a size into which each of the first and second transmission parts 6*c* and 6*d* of the force-sense imparting unit 6 can be inserted. Moreover, a first shaft column 1*d*, a second shaft column 21*e*, and a third shaft column 21*g* are formed on the mounting plate 21*f*. The first shaft column 1*d* is formed in a columnar shape, is inserted into a first shaft hole 4*e* of the first driving member 4, and can support the first driving member 4 so as to allow the first driving member 4 to swing. The second shaft column 21*e* is formed in a columnar shape, is inserted into a second shaft hole 5*e* of the second driving member 5, and can support the second driving member 5 so as to allow the second driving member 5 to swing. The third shaft column 21*g* is formed in a columnar shape, is inserted into the third shaft hole 25*e* of the third driving member 25, and can support the third driving member 25 so as to allow the third driving member 25 to swing.

As shown in FIG. 16, the upper portion of the upper case 21B is opened and a receiving space 21*a* is formed in the upper case 21B. The upper case 21B includes suspension portions 21*h* that are formed in a convex shape at the upper end portions of a pair of side walls, which are formed so as to face each other in the direction (Y1-Y2 direction) along the first virtual axis VS1, among side walls of the receiving space 21*a*. Meanwhile, the suspension portions 21*h* of one side wall of the side walls are respectively formed at positions that are symmetrical with respect to the first virtual axis VS1 interposed therebetween, and the suspension portions 21*h* of the other side wall of the side walls are also respectively formed at positions that are symmetrical with respect to the first virtual axis VS1 interposed therebetween and are spaced apart from each other by the same distance as the distance between the suspension portions 21*h* formed on the one side wall. Meanwhile, the suspension portion 21*h* has a width into which the guide member 27 can be inserted. Further, the bottom of the receiving space 21*a* is provided with a first rotating hole 21*k* which is formed at a position corresponding to the first engaging portion 4*a* and into which the first engaging portion 4*a* can be inserted, a second rotating hole 21*m* which is formed at a position corresponding to the second engaging portion 5*a* and into which the second engaging portion 5*a* can be inserted, and a third rotating hole 21*n* which is formed at a position corresponding to the third engaging portion 25*a* and into which the third engaging portion 25*a* can be inserted.

The upper case 21B is disposed in an orientation in which the upper case 21B can cover the upper portion of the mounting space 21*p* of the lower case 21A and can correspond to the first engaging portion 4*a*, the second engaging portion 5*a*, and the third engaging portion 25*a*, so that the base body 21 is formed. Meanwhile, a space which can accommodate the first driving member 4, the second driving member 5, and the third driving member 25 is formed between the mounting plate 21*f* and the upper case 21B.

Since the cover member 9 is the same as the component of the force-sense imparting type multidirectional input device 100 according to the first embodiment, the detailed description thereof will be omitted but the cover member 9 has a size that can cover the receiving space 21*a*.

The slider 22 is made of a synthetic resin material, and is formed in the shape of a plate that has a rectangular shape in a plan view (when seen from the Z1 direction or the Z2 direction) as shown in FIGS. 18A to 18C. As shown in FIG. 18B, the upper surface (the surface corresponding to the Z1 direction) of the slider 22 is formed so as to be curved along the outer periphery of a cylinder having an axis on the first virtual axis VS1. Meanwhile, the first virtual axis VS1 is positioned below the slider 22. Further, the operating member 3 is disposed near an apex of the upper surface of the slider 22 so as to protrude in a direction perpendicular to a virtual plane that is tangent to the apex. Meanwhile, in this embodiment, the operating member 3 and the slider 22 are formed integrally with each other by injection molding.

Furthermore, as shown in FIG. 18C, the slider 22 includes a bottom portion 22*d* on the lower surface thereof and the bottom portion 22*d* is formed of a rectangular flat surface, which is symmetrical with respect to the first virtual axis VS1 in the plan view of the lower surface of the slider 22. Moreover, the bottom portion 22*d* is provided with a first guide groove 22*b* into which the first engaging portion 4*a* can be inserted, a second guide groove 22*c* into which the second engaging portion 5*a* can be inserted, and a third guide groove 22*e* into which the third engaging portion 25*a* can be inserted. Meanwhile, the first guide groove 22*b* is formed in the shape of a groove that linearly extends in a direction (the X1-X2 direction) orthogonal to the first virtual axis VS1. Further, the first guide groove 22*b* is disposed in the middle portion of the bottom portion. The second guide groove 22*c* is formed in the shape of a groove that linearly extends in the extending direction (the Y1-Y2 direction) of the first virtual axis VS1. Meanwhile, the second guide groove 22*c* extends from a middle portion, which corresponds to the X1 direction, of the bottom portion 22*d* in the Y1 direction. Furthermore, the third guide groove 22*e* is formed in the shape of a groove that linearly extends in the extending direction (the Y1-Y2 direction) of the first virtual axis VS1. Meanwhile, the third guide groove 22*e* extends toward the middle of the bottom portion from the vicinity of a corner of the bottom portion that corresponds to the X2 direction and is present at a portion of the bottom portion 22*d* corresponding to the Y2 direction. Moreover, the first guide groove 22*b*, the second guide groove 22*c*, and the third guide groove 22*e* are formed so as to be separated from each other.

Further, the slider 22 includes guide holes 22*a*, which are shown in FIG. 18B, on the side surfaces thereof that correspond to the Y1-Y2 direction shown in FIG. 18A. The guide hole 22*a* is a through hole, and has a substantially rectangular cross-sectional shape. Furthermore, the guide holes 22*a* are formed so as to extend along the first virtual axis VS1 at positions, which are arranged in the direction orthogonal to the first virtual axis VS1 so as to be symmetrical to each other, with the position of the operating member 3 interposed therebetween. Meanwhile, the guide holes 22*a* are inclined with respect to the extending direction of the operating member 3 (a Z1-Z2 direction) about the first virtual axis VS1 as a center by the same angle (angle An), and are formed at portions that are spaced apart from the first virtual axis VS1 by the same distance (a distance L). That is, the guide holes 22*a* are formed along the outer periphery of a cylinder having an axis on the first virtual axis VS1. Moreover, the guide hole 22*a* has a size into which the guide member 27 can be inserted.

Figure 19:
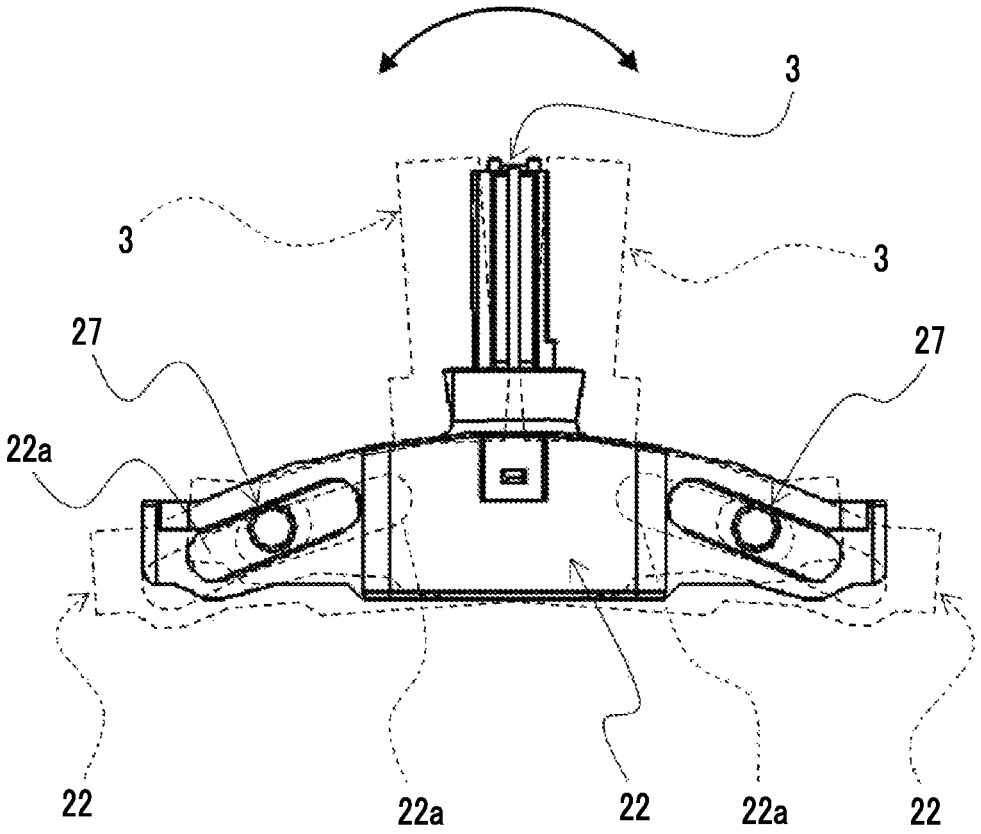
FIG. 19 is a schematic side view showing the state of the swing operation of the slider 22 of the second embodiment in a direction orthogonal to a first virtual axis VS1.
Figure 20:
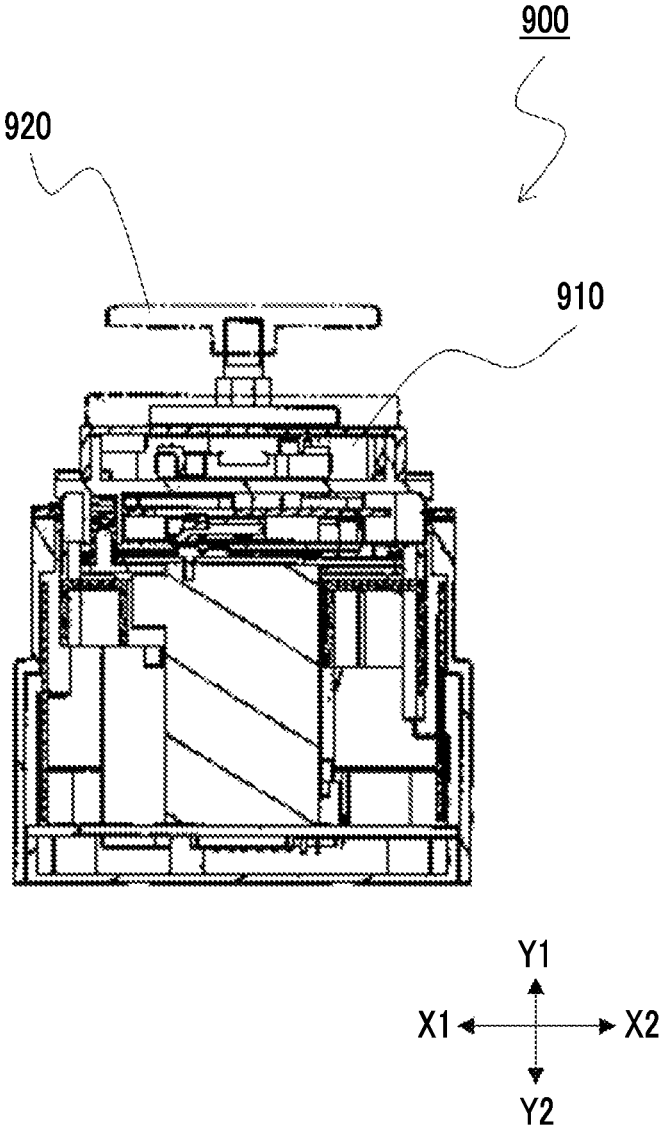
FIG. 20 is a cross-sectional view showing the structure of a force-sense imparting type multidirectional input device disclosed in Japanese Unexamined Patent Application Publication No. 2012-79620.

Next, the structure of the force-sense imparting type multidirectional input device 200 will be described with reference to FIGS. 14, 17A and 17B, and 19. FIG. 19 is a schematic side view showing the state of the swing of the slider 22 of the second embodiment in the direction orthogonal to the first virtual axis VS1. Meanwhile, for easy description, only the slider 22 integrated with the operating member 3 and the guide members 27 are shown in FIG. 19.

As shown in FIGS. 17A and 17B, the force-sense imparting unit 6 is fixed to the mounting plate 21*f* by screwing so that the first transmission part 6*c* of the first motor 6*a* and the second transmission part 6*d* of the second motor 6*b* are inserted into the communication holes 21*c* of the mounting plate 21*f*. The mounting plate 21*f* to which the force-sense imparting unit 6 is locked is disposed in the mounting space 21*p* of the lower case 21A, the force-sense imparting unit 6 is disposed in the lower case 21A, and the first and second transmission parts 6*c* and 6*d* are disposed so as to protrude into the mounting space 21*p*. The mounting plate 21*f*, the force-sense imparting unit 6, and the first and second transmission parts 6*c* and 6*d* are fixed by screwing. The first driving member 4 is disposed in the mounting space 21*p* so that the first shaft column 21*d* is inserted into the first shaft hole 4*e* and the first driving member 4 can rotate about the first shaft column 21*d*. At this time, the first engaging portion 4*a* protrudes upward (in a direction perpendicular to the mounting plate 21*f*), and the first gear portion 4*c* is engaged with the first transmission part 6*c* of the first motor 6*a*. Further, the second driving member 5 is disposed in the mounting space 21*p* so that the second shaft column 21*e* is inserted into the second shaft hole 5*e* and the second driving member 5 can rotate about the second shaft column 21*e*. At this time, the second engaging portion 5*a* protrudes upward, and the second gear portion 5*c* is engaged with the second transmission part 6*d* of the second motor 6*b*. Furthermore, the third driving member 25 is disposed in the mounting space 21*p* so that the third shaft column 21*g* is inserted into the third shaft hole 25*e* and the third driving member 25 can rotate about the third shaft column 21*g*. At this time, the third engaging portion 25*a* protrudes upward, and the third gear portion 25*c* is engaged with the second transmission part 6*d* of the second motor 6*b*. Meanwhile, the second driving member 5 and the third driving member 25 are connected to each other through the second transmission part 6*d* of the second motor 6*b*, and the second gear portion 5*c* and the third gear portion 25*c* are formed at the same pitch. For this reason, the second driving member 5 and the third driving member 25 swing while interlocking with each other, and the swing angles of the second and third driving members 5 and 25 are also equal to each other.

The upper case 21B is disposed so as to overlap with the mounting space 21*p* in which the first driving member 4, the second driving member 5, and the third driving member 25 are disposed. The upper case 21B is disposed in an orientation where the side walls at which the suspension portions 21*h* are formed are arranged side by side along the first virtual axis VS1. The first engaging portion 4*a* is swingably inserted into the first rotating hole 21*k*, the second engaging portion 5*a* is swingably inserted into the second rotating hole 21*m*, and the third engaging portion 25*a* is swingably inserted into the third rotating hole 21*n*, so that the first to third engaging portions protrude into the receiving space 21*a*. At this time, each of the first driving member 4, the second driving member 5, and the third driving member 25 can swing without coming into contact with the upper case 21B.

Further, the guide members 27 are inserted into one guide hole 22*a* and the other guide hole 22*a* of the slider 22, respectively, and the slider 22 into which the guide members 27 have been inserted is disposed in the receiving space 21*a*. At this time, both end portions of the guide members 27 are respectively supported by the suspension portions 21*h*, and are fixed by screwing or the like. Accordingly, the two guide members 27 are suspended in the receiving space 21*a* in the direction along the first virtual axis VS1 so as to be separated from each other, so that the slider 22 is disposed so as to be separated from the bottom in the receiving space 21*a*. Since the slider 22 is disposed as described above and the guide members 27 slide in the guide holes 22*a*, the slider 22 can be slidingly moved along the first virtual axis VS1 and can swing about the first virtual axis VS1 in the direction orthogonal to the first virtual axis VS1 as shown in FIG. 19. Furthermore, the first engaging portion 4*a* is slidably inserted into the first guide groove 22*b* of the slider 22 that is disposed as described above, the second engaging portion 5*a* is slidably inserted into the second guide groove 22*c*, and the third engaging portion 25*a* is slidably inserted into the third guide groove 22*e*.

Moreover, as shown in FIG. 14, the cover member 9 is disposed so as to cover the upper portion of the receiving space 21*a* while the operating member 3 is inserted into the operation opening 9*a*, and is fixed to the base body 21 (the upper case 21B) by screwing. Meanwhile, when the slider 22 swings to the end of the operation area, the guide holes 22*a* of the slider 22 come into contact with the guide members 27 and the operating member 3 does not come into contact with the operation opening 9*a*. Further, when the slider 22 is slidingly moved to the end of the operation area, the slider 22 and the base body 21 (upper case 21B) come into contact with each other and the operating member 3 and the operation opening 9*a* do not come into contact with each other. The force-sense imparting type multidirectional input device 200 is formed in this way. Furthermore, although not shown, the force-sense imparting type multidirectional input device 200 includes encoders that can detect the swing angles of the first and second driving members 4 and 5 like the force-sense imparting type multidirectional input device 100 according to the first embodiment. Since the encoder has a structure that can switch the conduction state and the non-conduction state of an internal circuit for every constant rotation angle, it is possible to detect the swing direction and the degree of swing of the driving members by monitoring the switching.

The force-sense imparting type multidirectional input device 200, which is formed as described above, has a structure in which the third driving member 25 is added to the force-sense imparting type multidirectional input device 100 according to the first embodiment, but the third driving member 25 performs the same motion while interlocking with the motion of the second driving member 5. Accordingly, since the operation of the force-sense imparting type multidirectional input device 200, which interlocks with the motion of the slider 22, is the same as the operation of the force-sense imparting type multidirectional input device 100 according to the first embodiment, the detailed description of the operation of the force-sense imparting type multidirectional input device 200 will be omitted.

The effect of this embodiment will be described below.

In the force-sense imparting type multidirectional input device 200 according to this embodiment, the two guide members 27 formed in the shape of a column are suspended in the receiving space 21*a* in the direction along the first virtual axis VS1 so as to be separated from each other; the slider 22 includes the guide holes 22*a* that are formed along the outer periphery of a cylinder having an axis on the first virtual axis VS1 so as to pass through the slider; the guide holes 22*a* are formed at positions, which are arranged in the direction orthogonal to the first virtual axis VS1 so as to be symmetrical to each other, with the position of the operating member 3 interposed therebetween; the guide members 27 are inserted into one guide hole 22*a* and the other guide hole 22*a*, respectively, so that the slider 22 is disposed so as to be separated from the bottom in the receiving space 21*a*; and the slider 22 can be slidingly moved along the first virtual axis VS1 and can swing about the first virtual axis VS1 in the direction orthogonal to the first virtual axis VS1 since the guide members 27 slide in the guide holes 22*a*.

Accordingly, since the two guide members 27 are disposed so as to be inserted into the guide holes 22*a* that are formed along the outer periphery of a cylinder having an axis on the first virtual axis VS1 so as to pass through the slider, the guide members 27 slide in the guide holes 22*a*. According to this structure, the slider 22 can swing in the circumferential direction of the inner wall surfaces of the guide holes 22*a* and can be slidingly moved in the extending direction of the guide members 27. Accordingly, since the slider 22 can be swung according to the motion of a hand, which causes the rotation of the wrist of an operator, in the operating direction in which the operator easily operates the slider by rotating the wrist, an effect of providing a force-sense imparting type multidirectional input device, which is easy to operate, is obtained.

The force-sense imparting type multidirectional input device 200 according to this embodiment includes the third driving member 25 that performs the same operation while interlocking with the second driving member 5. Further, the third guide groove 22*e* is formed at the slider 22 so as to be parallel to the second guide groove 22*c*. Furthermore, the third guide groove 22*e* is formed on the slider 22 so as to be parallel to the second guide groove 22*c*.

Accordingly, for example, since the second engaging portion 5*a* comes into contact with the inner wall of the second guide groove 22*c* and the third engaging portion 25*a* comes into contact with the inner wall of the third guide groove 22*e* even though a force that rotates the slider 22 about the operating member 3 is applied to the slider 22, it is possible to prevent the rotation of the slider 22. Therefore, an effect of providing the force-sense imparting type multidirectional input device, which is easy to operate, is obtained.

The force-sense imparting type multidirectional input devices according to the embodiments of the invention have been specifically described above. However, the invention is not limited to the above-mentioned embodiments and may include various modifications without departing from the scope of the invention. For example, the invention may include the following modified embodiments, and these embodiments are also included in the technical scope of the invention.

(1) In the first and second embodiments, the position of the first engaging portion 4*a* of the first driving member 4 and the position of the first gear portion 4*c* may be changed as necessary. Meanwhile, even in the cases of the second and third driving members 5 and 25, likewise, the positional relationship between the second engaging portion 5*a* and the second gear portion 5*c* and the positional relationship between the third engaging portion 25*a* and the third gear portion 25*c* may be changed as necessary.

(2) A case in which the force-sense imparting type multidirectional input device is mounted on a vehicle has been described in the first and second embodiments. However, the use of the force-sense imparting type multidirectional input device is not limited to the case in which the force-sense imparting type multidirectional input device is mounted on a vehicle, and the force-sense imparting type multidirectional input device may be used as an input device of, for example, a game controller.

(3) In the second embodiment, the slider 22 has been disposed in the receiving space 21*a* so as to be supported by the guide members 27 and the cover member 9 has been disposed so as to cover the upper portion of the receiving space 21*a*. However, a biasing member such as a leaf spring may be provided between the cover member 9 and the slider 22 to bias the slider 22 downward so that the slider 22 comes into press contact with the guide members 27. When the slider 22 is made to come into press contact with the guide members 27 by the biasing member in this way, the rattling of the slider 22 is suppressed. Accordingly, an effect of preventing the generation of noises caused by vibration or the like or improving detection accuracy for an operation is obtained.

(4) The guide hole 22*a* has a substantially rectangular cross-sectional shape in the second embodiment, but may have a cross-sectional shape that is curved along the outer periphery of a cylinder having an axis on the first virtual axis VS1.

It should be understood by those skilled in the art that various modifications, combinations, sub-combinations and alterations may occur depending on design requirements and other factors insofar as they are within the scope of the appended claims of the equivalents thereof.

What is claimed is:

1. A force-sense imparting type multidirectional input device comprising:

a base body that includes a receiving space;

a slider that is movably disposed in the receiving space;

an operating member that is integrated with the slider;

a first driving member that includes a first engaging portion rotationally driven along the movement of the slider;

a second driving member that includes a second engaging portion rotationally driven along the movement of the slider;

a force-sense imparting unit that imparts a sense of force to an operator through the operating member, wherein the slider is slidingly moved along a first virtual axis and swings about the first virtual axis in a direction orthogonal to the first virtual axis, the first engaging portion of the first driving member is rotationally driven with the sliding movement of the slider, and the second engaging portion of the second driving member is rotationally driven with the swing of the slider;

wherein two guide members configured in the shape of a column are suspended in the receiving space in a direction along the first virtual axis so as to be separated from each other, the slider includes guide holes that are disposed along the outer periphery of a cylinder having an axis on the first virtual axis so as to pass through the slider, the guide holes are disposed at positions, which are arranged in a direction orthogonal to the first virtual axis so as to be symmetrical to each other, with the position of the operating member interposed therebetween, the guide members are inserted into one guide hole and the other guide hole, respectively, so that the slider is disposed so as to be separated from a bottom in the receiving space, and the slider is slidingly moved along the first virtual axis and swings about the first virtual axis in a direction orthogonal to the first virtual axis since the guide members slide in the guide holes.

2. The force-sense imparting type multidirectional input device according to claim 1, wherein a guide member, which includes a guide surface curved along an outer peripheral surface of a cylinder and into which the first and second engaging portions are swingably inserted from a back side of the guide surface, is disposed in the receiving space, and the slider includes a sliding surface that is configured so as to come into surface contact with the guide surface, is disposed so that the sliding surface and the guide surface are engaged with each other, and slides along the guide surface.

3. The force-sense imparting type multidirectional input device according to claim 2, wherein regulating members are disposed at both ends of an arc of the guide surface, which is formed by the guide surface, so as to extend in an extending direction of the guide surface.

4. The force-sense imparting type multidirectional input device according to claim 1, wherein the force-sense imparting type multidirectional input device is mounted on a vehicle so that a direction in which the slider is slidingly moved corresponds to a longitudinal direction of the vehicle.

5. The force-sense imparting type multidirectional input device according to claim 1, wherein power is applied from the force-sense imparting unit and the first and second engaging portions of the first and second driving members are individually and rotationally driven.

* * * * *